US012790059B2

(12) United States Patent
Geßner et al.

(10) Patent No.: US 12,790,059 B2
(45) Date of Patent: Nov. 10, 2026

(54) METHOD FOR OPERATING A PACKAGING DEVICE FOR PACKAGING MEDICAMENTS PROVIDED IN TABLET FORM, AND METHOD FOR OPERATING A PACKAGING DEVICE

(71) Applicant: KNAPP AG, Hart bei Graz (AT)

(72) Inventors: Jürgen Geßner, Munich (DE); Michael Muhr, Hartl (AT); Luise Kellerhaus, Dülmen (DE); Christoph Gailberger, Graz (AT)

(73) Assignee: KNAPP AG, Hart bei Graz (AT)

( * ) Notice: Subject to any disclaimer, the term of this patent is extended or adjusted under 35 U.S.C. 154(b) by 190 days.

(21) Appl. No.: 18/855,033

(22) PCT Filed: Apr. 6, 2023

(86) PCT No.: PCT/EP2023/059202

§ 371 (c)(1),
(2) Date: Oct. 8, 2024

(87) PCT Pub. No.: WO2023/194555

PCT Pub. Date: Oct. 12, 2023

(65) Prior Publication Data

US 2025/0256880 A1 Aug. 14, 2025

(30) Foreign Application Priority Data

Apr. 8, 2022 (DE) ..... 102022108588.0
Jun. 14, 2022 (DE) ..... 102022114943.9
Dec. 13, 2022 (EP) ..... 22213170

(51) Int. Cl.
*B65B 65/00* (2006.01)
*B65B 5/10* (2006.01)
(Continued)

(52) U.S. Cl.
CPC ..... *B65B 65/003* (2013.01); *B65B 5/103* (2013.01); *B65B 11/52* (2013.01); *B65B 35/24* (2013.01); *B65B 69/0058* (2013.01)

(58) Field of Classification Search
CPC ..... B65B 11/52; B65B 35/24; B65B 5/04; B65B 5/103; B65B 65/003; B65B 69/0058
See application file for complete search history.

(56) References Cited

U.S. PATENT DOCUMENTS 5,460,471 A * 10/1995 Connor ..... B65B 69/0058 414/811
9,493,304 B2 11/2016 Wagner
(Continued)

FOREIGN PATENT DOCUMENTS

DE 102005012910 A1 9/2006
EP 1564160 A1 8/2005
(Continued)

OTHER PUBLICATIONS

International Search Report and Written Opinion in PCT Application No. PCT/EP2023/059202; mailed on Sep. 1, 2023; re. Claim Nos. 1-6.

*Primary Examiner* — Himchan Song
(74) *Attorney, Agent, or Firm* — Howard IP Law Group PC

(57) ABSTRACT

A method for operating a repackaging device for repacking medications comprising transportable pill containers, each container exhibiting a receptacle compartment and either exhibiting a dispensing mechanism or an opening sealed by a foil, wherein a pill located in the compartment can be pushed out through the opening, destroying the foil, a working storage device in which some pill containers can be stored and a filling device, a packaging station, wherein a device transports a pill removed from the pill container to the station, a mixing storage area in which some pill
(Continued)

containers and packages containing pills or blisters can be stored, a workstation for unpacking pills or blisters in packages and a supply device with which a pill container and/or package can be supplied from the mixing storage to the workstation, and/or a discharge device with which a pill container and/or a package can be supplied to the mixing storage.

6 Claims, 13 Drawing Sheets

(51) Int. Cl.

| | |
|---|---|
| ***B65B 11/52*** | (2006.01) |
| ***B65B 35/24*** | (2006.01) |
| ***B65B 69/00*** | (2006.01) |

(56) References Cited

U.S. PATENT DOCUMENTS

| | | | | |
|---|---|---|---|---|
| 2003/0101694 | A1* | 6/2003 | Browning | B65B 69/0058 53/381.2 |
| 2011/0202171 | A1* | 8/2011 | Rosenbaum | B65B 35/18 707/758 |
| 2015/0353213 | A1 | 12/2015 | Kohl | |
| 2020/0346806 | A1* | 11/2020 | Joplin | B65B 35/24 |
| 2022/0227581 | A1* | 7/2022 | Hoffman | B65B 5/067 |
| 2022/0363481 | A1* | 11/2022 | Terzini | B65B 35/10 |
| 2023/0043100 | A1* | 2/2023 | Davis | A61J 1/035 |
| 2025/0161161 | A1* | 5/2025 | Geßner | A61J 1/03 |
| 2025/0368372 | A1* | 12/2025 | Bertolani | B65B 43/10 |

FOREIGN PATENT DOCUMENTS

| | | | |
|---|---|---|---|
| EP | 1598291 | A2 | 11/2005 |
| EP | 2042447 | A1 | 4/2009 |
| EP | 2463205 | A1 | 6/2012 |
| EP | 2826732 | A1 | 1/2015 |
| EP | 2993133 | A1 | 3/2016 |
| EP | 3949934 | A1 | 2/2022 |

* cited by examiner

METHOD FOR OPERATING A PACKAGING DEVICE FOR PACKAGING MEDICAMENTS PROVIDED IN TABLET FORM, AND METHOD FOR OPERATING A PACKAGING DEVICE

CROSS-REFERENCE TO RELATED APPLICATIONS

This application is a national stage application under 35 U.S.C. § 371 of International Patent Application No. PCT/EP2023/059202 filed on Apr. 6, 2023, which claims priority to DE 10 2022 108 588.0 filed on Apr. 8, 2022, DE 10 2022 114 943.9 filed on Jun. 14, 2022, and EP 22 213 170.8, filed on Dec. 13, 2022, the subject matter of which is incorporated by reference herein in its entirety for all purposes.

FIELD OF INVENTION

The invention relates to a method for operating a repackaging device for repacking medications in pill form. The invention also relates to a method for operating a repackaging device.

BACKGROUND

EP 2 993 133 A1 discloses a repackaging device for repackaging medications in pill form. This exhibits a variety of pill containers that can be transported, which are referred to in EP 2 993 133 A1 as blister carriers. The blister carrier can hold an original blister pack, often also called a push-through pack. By way of arranging the original blister pack in the blister carrier, the blister carrier has a plurality of compartments, namely the number of recesses usually provided in the plastic or aluminum foil of such an original blister pack, which are closed by the cover foil. Thus, the blister carrier from EP 2 993 133 A1 has a plurality of compartments for the receptacle of at least one pill, whereby the respective compartment exhibits an opening closed by a foil, whereby a pill located in the compartment can be pushed out of the compartment through the opening, destroying the foil.

The device known from EP 2 993 133 A1 also exhibits a working storage device in which some pill containers can be stored. In EP 2 993 133 A1, the working storage device exhibits a conveying device for separating and supplying original blisters packed in blister carriers assigned to a respective original blister type, an intermediate storage device with random access for the intermediate storage of the blister carriers, and an ejection device for ejecting a defined number of units of a selected medication from the respective original blister into a filling blister. Consequently, the device known from EP 2 993 133 A1 exhibits a filing device in which a pill can be removed from a compartment of a pill container, and a packaging station in which a pill removed from the pill container in the filing device can be packed in a new package. Furthermore, the device known from EP 2 993 133 A1 exhibits a conveyor carriage that can be used to supply the blister carrier from the intermediate storage to the deblistering device containing the ejection device along a conveyor line. The pill ejected by the ejection device falls along a shaft, which also contains a pre-dosing magazine, towards the packaging station. This can be seen as a pill transport device that brings a pill removed from the pill container in the filing device to the packaging station.

From the practical use of the device known from EP 2 993 133 A1, it is known that packages with original blister packs, but also blister carriers, are stored in storage facilities and placed manually on conveyor trolleys of the conveyor route leading to the intermediate storage area.

SUMMARY

In view of this, the object of the invention was to propose a method for operating a repackaging device for repackaging medications in pill form that would make it possible to carry out the repackaging more safely and/or make it possible to carry out the repackaging more quickly and/or make it possible to carry out the repackaging for a larger number of different medications in pill form.

The invention is based on a repackaging device that is equipped with a working storage device and a filing device, as well as a packaging station and a mixing storage device, and also with a workstation for unpacking pills or blisters located in packages.

The invention is based on the assumption that, in a minimal solution, advantages over the prior art are already achieved with such a repackaging device if a conveyor system with several conveyor paths is provided and at least one of the subsequent method steps is carried out:

- a pill container or a package is supplied to the workstation from the mixing storage via a supply device belonging to the conveyor system,
- a pill container or a package is supplied from the workstation to the mixing storage via a discharge device belonging to the conveyor system,
- a pill container is supplied from the workstation to the working storage device via a conveyor device belonging to the conveyor system,
- a pill container or package is supplied from the workstation to the workstation again via a conveyor device belonging to the conveyor system,
- a pill container is supplied from the working storage device to the workstation via a conveyor device belonging to the conveyor system,
- a pill container is supplied from the working storage device to the mixing storage device via a conveyor device belonging to the conveyor system,
- a pill container is supplied to a pill container removal nozzle by means of a conveyor device belonging to the conveyor system from the working storage device,
- a pill container is supplied to a second working storage device by means of a conveyor device belonging to the conveyor system from a first working storage device,
- a pill container is supplied to the working storage device by means of a conveyor device belonging to the conveyor system from the mixing storage,
- a pill container is supplied from the mixing storage area to a pill container removal nozzle via a conveyor device belonging to the conveyor system,
- a pill container or package is supplied from the mixing storage area to the mixing storage area via a conveyor device belonging to the conveyor system,
- a pill container or package is supplied to the mixing storage area via a storage conveyor belt.

In a preferred embodiment in which even further advantages are achieved, at least one of the two subsequent method steps can be carried out:

- a pill container or a package is supplied to the workstation from the mixing storage via a supply device belonging to the conveyor system,
- a pill container or a package is supplied from the workstation to the mixing storage via a discharge device belonging to the conveyor system, and at least one of the subsequent method steps can be carried out:

- a pill container is supplied from the workstation to the working storage device via a conveyor device belonging to the conveyor system,
- a pill container or a package is supplied back from the workstation to the workstation via a conveyor device belonging to the conveyor system,
- a pill container is supplied from the working storage device to the workstation via a conveyor device belonging to the conveyor system,
- a pill container is supplied from the working storage device to the mixing storage area by means of a conveyor device belonging to the conveyor system,
- a pill container is supplied from the working storage device to a pill container removal nozzle by means of a conveyor device belonging to the conveyor system,
- a pill container is supplied from a first working storage device to a second working storage device by means of a conveyor device belonging to the conveyor system,
- a pill container is supplied from the mixing storage to the working storage device via a conveyor device belonging to the conveyor system,
- a pill container is supplied from the mixing storage to a pill container removal nozzle via a conveyor device belonging to the conveyor system,
- a pill container or package is supplied back from the mixing storage to the mixing storage via a conveyor device belonging to the conveyor system,
- a pill container or package is supplied to the mixing storage via a storage conveyor belt.

By increasing the number of method steps, the effectiveness and flexibility of the method can be increased.

In a preferred embodiment in which even greater advantages can be achieved, the two subsequent method steps can be carried out:

- a pill container or a package is supplied to the workstation from the mixing storage via a supply device belonging to the conveyor system,
- a pill container or a package is supplied from the workstation to the mixing storage via a discharge device belonging to the conveyor system, and at least one of the subsequent method steps can be carried out:

- a pill container is supplied from the workstation to the working storage device via a conveyor device belonging to the conveyor system,
- a pill container or a package is supplied back from the workstation to the workstation via a conveyor device belonging to the conveyor system,
- a pill container is supplied from the working storage device to the workstation via a conveyor device belonging to the conveyor system,
- a pill container is supplied from the working storage device to the mixing storage area by means of a conveyor device belonging to the conveyor system,
- a pill container is supplied from the working storage device to a pill container removal nozzle by means of a conveyor device belonging to the conveyor system,
- a pill container is supplied from a first working storage device to a second working storage device by means of a conveyor device belonging to the conveyor system,
- a pill container is supplied from the mixing storage to the working storage device via a conveyor device belonging to the conveyor system,
- a pill container is supplied from the mixing storage to a pill container removal nozzle via a conveyor device belonging to the conveyor system,
- a pill container or package is supplied back from the mixing storage to the mixing storage via a conveyor device belonging to the conveyor system,
- a pill container or package is supplied to the mixing storage via a storage conveyor belt.

By increasing the number of method steps, the effectiveness and flexibility of the method can be increased. In addition, the implementation of the two method steps

- a pill container or a package is supplied to the workstation from the mixing storage via a supply device belonging to the conveyor system,
- a pill container or a package is supplied from the workstation to the mixing storage via a discharge device belonging to the conveyor system, allows the mixing storage area to be fully utilized. This can significantly increase the efficiency of the method.

In a preferred embodiment in which even greater advantages can be achieved, the two subsequent method steps can be carried out:

- a pill container or a package is supplied to the workstation from the mixing storage via a supply device belonging to the conveyor system,
- a pill container or a package is supplied from the workstation to the mixing storage via a discharge device belonging to the conveyor system, and at least two of the subsequent method steps can be carried out:

- a pill container is supplied from the workstation to the working storage device via a conveyor device belonging to the conveyor system,
- a pill container or a package is supplied back from the workstation to the workstation via a conveyor device belonging to the conveyor system,
- a pill container is supplied from the working storage device to the workstation via a conveyor device belonging to the conveyor system,
- a pill container is supplied from the working storage device to the mixing storage area by means of a conveyor device belonging to the conveyor system,
- a pill container is supplied from the working storage device to a pill container removal nozzle by means of a conveyor device belonging to the conveyor system,
- a pill container is supplied from a first working storage device to a second working storage device by means of a conveyor device belonging to the conveyor system,
- a pill container is supplied from the mixing storage to the working storage device via a conveyor device belonging to the conveyor system,
- a pill container is supplied from the mixing storage to a pill container removal nozzle via a conveyor device belonging to the conveyor system,
- a pill container or package is supplied back from the mixing storage to the mixing storage via a conveyor device belonging to the conveyor system,
- a pill container or package is supplied to the mixing storage via a storage conveyor belt.

In a preferred embodiment in which even greater advantages can be achieved, the two subsequent method steps can be carried out:

- a pill container or a package is supplied to the workstation from the mixing storage via a supply device belonging to the conveyor system, a pill container or a package is supplied from the workstation to the mixing storage via a discharge device belonging to the conveyor system, and at least three of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least four of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least five of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least six of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least seven of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least eight of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and at least nine of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

In a preferred embodiment in which even greater advantages can be achieved, the two subsequent method steps can be carried out:

a pill container or a package is supplied to the workstation from the mixing storage via a supply device belonging to the conveyor system, a pill container or a package is supplied from the workstation to the mixing storage via a discharge device belonging to the conveyor system, and all of the subsequent method steps can be carried out:

a pill container is supplied from the workstation to the working storage device via a conveyor device belonging to the conveyor system, a pill container or a package is supplied back from the workstation to the workstation via a conveyor device belonging to the conveyor system, a pill container is supplied from the working storage device to the workstation via a conveyor device belonging to the conveyor system, a pill container is supplied from the working storage device to the mixing storage area by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a pill container removal nozzle via a conveyor device belonging to the conveyor system, a pill container or package is supplied back from the mixing storage to the mixing storage via a conveyor device belonging to the conveyor system, a pill container or package is supplied to the mixing storage via a storage conveyor belt.

The effectiveness and flexibility of the method can be increased by the rising number of method steps. In addition, the complexity of the method can be increased so that more complex logistics can be realized with the method.

Supplying a pill container from the mixing storage to the workstation via a supply device belonging to the conveyor system makes it possible to provide the operator at the workstation with a pill container that the operator at the workstation can fill with one or more pills. It is possible that a completely empty pill container is provided to the operator from the mixing storage, which the operator then fills completely or partially with pills. However, additional or alternative methods are possible in which an empty pill container is supplied to the workstation via a separate route, for example by pushing a trolley filled with empty pill containers next to the workstation. In a preferred embodiment, it is part of the method that at least the supply of a pill container from the mixing storage to the workstation is carried out via a supply device belonging to the conveyor system.

The supply of a pill container from the mixing storage to the workstation via a supply device belonging to the conveyor system also makes it possible to supply a partially filled pill container, which has been set aside or stored temporarily in the mixing storage, to the operator at the workstation, who then fills the pill container with at least one pill. It is also possible for the operator at the workstation to remove one or more pills from the pill carrier coming from the mixing storage. For example, if the pill has reached its expiry date, or if the pill is incorrectly sorted in the pill carrier, or if the pill is needed for repackaging that the operator carries out at the workstation, or if an error or breakage has occurred during automated repackaging and the operator reopens an automatically unpackaged blister carrier and re-loads it, and needs certain pills to do so.

Supplying a pill container from the mixing storage to the workstation via a supply device belonging to the conveyor system can be used to manage the pill containers in the mixing storage. For example, they can be refilled with missing pills before the respective pill container is supplied to a workstation.

Supplying a package from the mixing storage to the workstation via a supply device belonging to the conveyor system makes it possible to provide the operator at the workstation with a package from which he can take a pill to put in a pill container, for example, if the tablet is needed for repacking, which the operator carries out at the workstation, for example if an error or breakage has occurred during the automated repacking and the operator reopens an automatically unpacked blister carrier and re-loads it, and needs certain pills for this. Supplying a package from the mixing storage to the workstation also makes it possible to remove a package from the mixing storage, for example if it has reached its expiry date. In a preferred embodiment, it is part of the method that at least the supply of a package from the mixing storage to the workstation is carried out via a supply device belonging to the conveyor system.

Supplying a pill container from the workstation to the mixing storage area via a discharge device belonging to the conveyor system makes it possible to store pill containers in the mixing storage area that are not initially used in the working storage device. If, for example, a package is unpacked at the workstation and its pills are first filled into a first pill container, which is then supplied to a working storage device, it is then possible to fill any remaining pills into another pill container (or several other pill containers), but not to supply them to the working storage device, but to store them in the mixing storage. This means that the operator has the option, for example, of either sending an opened package from the workstation to the mixing storage area or of using up the opened package and transferring its pills to pill containers, but then storing the pill containers that are not needed in the mixing storage area. Supplying a pill container from the workstation to the mixing storage area via a discharge device belonging to the conveyor system also makes it possible to store pill containers in the mixing storage area after a content check at the workstation. Supplying a pill container from the workstation to the mixing storage area via a discharge device belonging to the conveyor system also makes it possible to return pill containers that have been conveyed from the mixing storage area to the workstation in error back to the mixing storage area. In a preferred embodiment, it is part of the method that at least the supply of a pill container from the workstation to the mixing storage area is carried out via a discharge device belonging to the conveyor system.

Supplying a package from the workstation to the mixing storage area via a discharge device belonging to the conveyor system makes it possible to store an opened package, from which only a few pills have been taken at the workstation, in the mixing storage area until the remaining pills in the opened package are needed to fill a pill container. Supplying a package from the workstation to the mixing storage area via a discharge device belonging to the conveyor system also makes it possible to store packages in the mixing storage area for the first time. It is also possible, or alternatively, that the mixing storage has an independent storage conveyor belt, via which a package can be stored in the mixing storage. In a preferred embodiment, it is part of the method that at least the supply of a package from the workstation to the mixing storage is carried out via a discharge device belonging to the conveyor system.

Supplying a pill container from the workstation to the working storage device via a conveyor device belonging to the conveyor system makes it possible to supply pill containers that have been filled with pills at the workstation to the working storage device. In addition, pill containers whose contents have been checked at the workstation can be supplied to the workstation by means of this conveyor device. In a preferred embodiment, the method involves at least supplying a pill container from the workstation to the working storage device by means of a conveyor device belonging to the conveyor system.

Supplying a pill container or package from the workstation to the workstation via a conveyor device belonging to the conveyor system makes it possible to supply pill containers or packages that are to be supplied from the workstation to another location, for example the mixing storage device or the working storage device, but that recognition device, for example a scanner, or could not be read, to the workstation again; for example, to retry the recognition process or, for example, to change something at the workstation about the properties to be recognized by the recognition process, for example to print and stick on a new barcode. In a preferred embodiment, part of the method is that at least the supplying of a pill container or package from the workstation to the workstation is carried out via a conveyor device belonging to the conveyor system.

Supplying a pill container from the working storage device to the workstation via a conveyor device belonging to the conveyor system makes it possible to convey a pill container to the workstation for refilling. It is also possible to check the pill container at the workstation, for example, to see whether the fill level of the pill container stored in a system matches the actual fill level of the pill container. It is also possible to remove pills from the pill container at the workstation, for example if they have reached their expiry date, and preferably to replace them with new pills. In a preferred embodiment, part of the method involves supplying at least one pill container from the working storage device to the workstation via a conveyor device belonging to the conveyor system.

Supplying a pill container from the working storage device to the mixing storage via a conveyor device belonging to the conveyor system makes it possible to remove pill containers that are no longer needed in the working storage device, for example because it is foreseeable that the pills in the specific pill container will not be needed in the next orders for repacking, from the working storage device and store them temporarily in the mixing storage. In a preferred embodiment, part of the method involves supplying at least one pill container from the working storage device to the mixing storage device via a conveyor device belonging to the conveyor system.

Supplying a pill container from the working storage device to a removal nozzle via a conveyor device belonging to the conveyor system makes it possible to remove pill containers from the system after they have been used in the working storage device, for example to clean them. In a preferred embodiment, part of the method is that at least the supply of a pill container from the working storage device to a removal nozzle is carried out via a conveyor device belonging to the conveyor system.

Supplying a pill container from a first working storage device to a second working storage device via a conveyor device belonging to the conveyor system makes it possible, in the case of devices with two working storage devices, to exchange the pill containers between the working storage devices, for example if a pill container is not currently needed for the orders to be processed in the first working storage device, but is needed in the second working storage device to process orders. In a preferred embodiment, part of the method is to supply of a pill container from a first working storage device to a second working storage device via a conveyor device belonging to the conveyor system.

Supplying a pill container from the mixing storage area to the working storage via a conveyor device belonging to the conveyor system makes it possible to supply pill containers that are in stock in the mixing storage area directly to the working storage device without processing at the workstation. In a preferred embodiment, part of the method involves supplying at least one pill container from the mixing storage to the working storage device via a conveyor device belonging to the conveyor system.

Supplying a pill container from the mixing storage to a removal nozzle via a conveyor device belonging to the conveyor system makes it possible to remove pill containers from the mixing storage and from the system, for example, when they are to be cleaned. In a preferred embodiment, it is part of the method to supply at least one pill container from the mixing storage to a removal nozzle via a conveyor device belonging to the conveyor system.

Supplying a pill container or package from the mixing storage to the mixing storage via a conveyor device belonging to the conveyor system makes it possible to return a pill container or package to the mixing storage if it is determined after the start of the retrieval process from the mixing storage that the respective pill container or package is not needed after all. In a preferred embodiment, part of the method is that at least the supplying of a pill container or package from the mixing storage to the mixing storage is carried out via a conveyor device belonging to the conveyor system.

Supplying a pill container or package via a storage conveyor belt to the mixing storage area makes it possible to fill the mixing storage area with pill containers or packages without them having to be routed via the workstation. In a preferred embodiment, it is part of the method that at least one pill container or package is supplied to the mixing storage area via a storage conveyor belt.

By providing a workstation, a place is created where an operator can, for example, concentrated and efficiently remove an original blister pack from a package, such as a box, and insert the removed original blister pack into a blister carrier. An operator at a workstation can also transfer pills delivered in large packages, such as sacks, into pill containers in the form of magazines/canisters.

The invention makes it possible to propose a repackaging device for repackaging medications in pill form that makes it possible to make the repackaging completely separate from the source material (packages with pills/containers with loose pills) in a consistently automated process, and thus to carry it out more safely and/or to enable repacking to be carried out more quickly and/or to enable repacking to be carried out for a larger number of different medications in pill form and/or to drastically reduce the planning and organizational effort.

In the context of the present invention, a workstation is understood to mean, in particular, a specific spatial arrangement of an area of the device that can be operated using the method according to the invention, which allows an operator of the device to insert an original blister pack into a pill container designed as a blister carrier and/or a loose pill into a pill container.

In a preferred embodiment, the workstation has a work surface. In a preferred embodiment, the work surface is horizontal. The work surface may also be inclined, but preferably has an inclination angle of less than 45° to the horizontal. The work surface preferably exhibits an area of more than 0.5 $m^2$, preferably more than 1 $m^2$. The work surface is preferably smaller than 10 $m^2$, preferably smaller than 7 $m^2$.

In a preferred embodiment, the workstation exhibits a free space above the work surface in which devices can be located that can be used for placing an original blister pack in a pill container equipped as a blister carrier and/or a loose pill in a pill container, but into which no partitions project. Preferably, the free space extends horizontally over at least 75% of the work surface and vertically over more than 0.3 m, preferably over more than 0.5 m and particularly preferably over more than 0.7 m.

In a preferred embodiment, the workstation exhibits a printer. In a preferred embodiment, the printer is a label printer. In a preferred embodiment, the printer can be used to create labels with an optically readable code, in particular a barcode or a QR code. These labels can, for example, be stuck on newly filled pill containers and enable the specific pill container to be identified later in further process steps within the device. The labels can also be used to mark packages and pill containers whose contents have been changed at the workstation, for example, by removing a certain number of pills or by adding (replenishing) a number of pills. The printer is preferably connected to a computer at the workstation and/or integrated into a computer network that can be operated using the method according to the invention.

In a preferred embodiment, the workstation exhibits a reading device for an optically readable code, in particular preferably a barcode reader or a QR code reader. The reading device is in particular preferably connected to a computer at the workstation and/or integrated into a computer network belonging to the device operable with the method according to the invention.

In a preferred embodiment, the workstation exhibits a reader for an RFID tag. The reader can also be equipped as a writer for an RFID tag in order to write to an RFID tag. In particular, the reader is preferably connected to a computer at the workstation and/or integrated into a computer network belonging to the device operable with the method according to the invention.

In a preferred embodiment, the computer exhibits a display, in particular a screen. The display is particularly preferably connected to a computer at the workstation and/or integrated into a computer network belonging to the device operated using the method according to the invention.

In a preferred embodiment, the workstation exhibits an input means for a computer, in particular a keyboard or a touch screen. The input means is preferably connected to a computer at the workstation and/or integrated into a computer network belonging to the device operable with the method according to the invention.

In a preferred embodiment, the workstation exhibits a camera, in particular an image camera or a video camera. The camera is particularly preferably connected to a computer at the workstation and/or integrated into a computer network belonging to the device operated by the method according to the invention.

In a preferred embodiment, the workstation exhibits an air extractor for removing air from the open space of the workstation. The air extractor can be equipped as an extractor hood arranged above a work surface. The air extractor can also be arranged laterally next to an open space above the work surface. In particular, the air extractor is preferably connected to a computer at the workstation and/or integrated into a computer network belonging to the device operated using the method according to the invention.

In a preferred embodiment, the workstation exhibits forceps with which pills can be handled.

In a preferred embodiment, the workstation exhibits a pill-ejecting tray into which pills can be ejected from original blisters and ejected for later removal.

In a preferred embodiment, the workstation exhibits a holding device for a blister carrier, preferably a holding device that can hold several blister carriers next to one another, in particular several blister carriers horizontally next to one another.

In a preferred embodiment, the workstation exhibits an opening device for a pill container, by means of which a pill container can be held in a position in which the compartment of the pill container is open. In a particularly preferred embodiment, a compartment of a pill container can be opened automatically.

In a preferred embodiment, the workstation exhibits an automatic device for removing the packaging (e.g. clamping device with cutting device) and an automated repacking device, e.g. a handling system that repacks the unpacked original blisters into the pill containers provided.

In a preferred embodiment, the workstation exhibits a disposal container into which empty packages or empty original blisters or empty pill containers can be disposed.

In a preferred embodiment, the device exhibits several workstations. Embodiments are possible in which two or more workstations are equally equipped. This allows any type of activity that is to be carried out at a workstation to be carried out at any workstation. However, embodiments are also possible in which at least one workstation is equipped differently from another workstation. This makes it possible to equip different workstations for different types of activities.

The supply device provided in accordance with a preferred embodiment can be used to supply the package and/or an empty pill container or a partially filled pill container (for refilling) from the mixing storage to the operator at the workstation. Particularly in combination with computerized process control, which controls both the mixing storage and the supply device, process reliability can be increased. This makes it possible to supply the operator at the workstation only with the package and the pill container on which he is to work. This reduces the possibility of human error.

In a preferred embodiment, the supply device is a passive supply device. In particular, a passive supply device is understood to mean a device that can convey a package or a pill container over a conveyor line without the use of drive means. In particular, a passive supply device can be a chute or a spiral or a roller conveyor. A passive supply device can also be, for example, a drop tower, for example a shaft, with an insertion opening at the top and a dispensing opening at the bottom, in which the object falls into a soft catching device, e.g. a cushion, or the fall is braked by flaps, or the object falls onto an incline and is thus automatically dispensed to the side.

In a preferred embodiment, the supply device is an active supply device. In particular, an active supply device is understood to be a device that can convey a package or a pill container over a conveyor line using drive means. In a preferred embodiment, the supply device is a conveyor device that is elongated along a conveyor line, for example a conveyor belt. The active supply device can also be a rail on which the package or pill containers can be moved by a pushing or pulling mechanism.

In a preferred embodiment, the supply device exhibits an end section in which a package or pill container can be placed. An end section can, for example, be a horizontal or slightly inclined surface (particularly preferably with an angle of inclination of less than 30°) at the end of the supply device. The end section can be partially enclosed by a frame to hold back the package or pill container, or to slow down and/or stop the movement of the package or pill container. An end section of a supply device can also be a basket into which a package or pill container falls.

In a preferred embodiment, the feeding device exhibits a lock that separates the interior of the mixing storage from the workstation. The lock is designed, for example, so that one side can only be opened when the other side is closed. This means that only the interior of the lock is ever "taken along" when objects are transferred. In a preferred embodiment, the clean area, in particular the interior of the mixing storage, can be provided with a higher air pressure (e.g. via a ventilation system of the mixing storage) than the "dirty" area, in particular the workstation, when the clean side is opened, clean air is allowed into the chamber, after the dirty side is closed and opened, some clean air flows into the dirty side until the air pressure is equalized.

In a preferred embodiment, the feeder exhibits an illumination or highly visible switchable marking so that even an inattentive operator removes the goods to be processed, for example the package or pill container to be processed, from the correct feeder and/or it is indicated to him that the goods to be processed have been delivered completely and/or the delivered goods have not yet been completely removed.

In a preferred embodiment, the end of the feeder is monitored by sensors so that the existence of an old order still on the feeder can be detected, for example, to recognize the incomplete removal and/or to supply a feeder with only one order, e.g. only the package and its associated pill carrier, and only when the feeder is empty to release it again for a new delivery.

In a preferred embodiment, the start of the supply device via the feeder is monitored by sensors, for example to detect overfilling.

In a preferred embodiment, the end of the supply device is protected from access by a closure, e.g. a locked flap, to allow access only when a condition determined by the control of the flap has been detected, for example complete delivery of the order, complete processing of a previous order from another supply.

In a preferred embodiment, the supply device is a carriage on which the pill containers and/or the package are located.

In a preferred embodiment, if the workstation exhibits a work surface, the end of the supply device, in particular the end section as viewed in a horizontal direction, is located less than 2 m, preferably less than 1.5 m, preferably less than 1 m, from an edge of the work surface. It is particularly preferred when an operator working at the work surface can reach a package or pill container located at the end of the supply device without having to take a step, or at least with only a few steps. There are also possible embodiments in which the supply device is directly adjacent to the work surface or ends directly at the work surface, for example, a chute opens directly onto an edge of the work surface or may even extend over the edge of the work surface.

In a preferred embodiment, if the workstation exhibits a work surface, the end of the supply device, in particular the end section as viewed in a vertical direction, is arranged at the level of or slightly above the work surface or slightly below it, in particular less than 2 m, preferably less than 1.5 m, preferably less than 1 m, preferably less than 0.5 m, from the surface of the work surface. It is particularly preferred when an operator working at the work surface can reach a package or pill container located at the end of the supply device without bending or stretching.

In a preferred embodiment, at least one supply device is provided, by means of which a pill container and/or a package can be supplied to the workstation from the mixing storage. However, embodiments are also possible in which more than one supply device is provided per workstation. In a preferred embodiment, less than 10, more particularly less than 5, more particularly less than 4 supply devices are provided per workstation.

If the device that can be operated using the method according to the invention is equipped with several workstations, then in a preferred embodiment it is envisaged that each workstation has its own supply device. If the respective supply device is designed, for example, as a chute, then a chute can be provided for each workstation that is assigned to it. There are possible embodiments in which the supply devices of the workstations are all of the same type, for example, all chutes. However, embodiments are also possible in which, in the case of several workstations, at least one workstation exhibits a supply device of a type that is different from the type of another workstation. For example, one workstation may have a passive supply device, such as a chute, and another workstation may have an active supply device, such as a conveyor belt.

In a preferred embodiment, the supply device exhibits a pneumatic tube.

The discharge device provided in a preferred embodiment can be used to return filled pill containers to the mixing storage. Instead of transporting filled pill containers to the working storage device, the discharge device provided in accordance with the invention offers the alternative of returning pill containers handled at the workstation to the mixing storage. This increases process diversity and allows for more efficient work. For example, a package filled with several original blister packs, such as a box, can be completely emptied at the workstation, with each original blister pack of the box being placed in a blister carrier at the workstation. Then a blister carrier equipped in this way can be placed in the working storage device, while the remaining blister carriers are moved to the mixing storage This prevents an operator from handling the same box multiple times.

In a preferred embodiment, the discharge device is a passive discharge device. In particular, a passive discharge device is understood to be a device that can convey a package or a pill container over a conveyor line without the use of drive means. In particular, a passive discharge device can be a chute or a spiral.

In a preferred embodiment, the discharge device exhibits a passive part and an active part that is adjacent to the passive part and takes over pill containers or packages from the passive part.

In a preferred embodiment, a basket or container or other storage is located at the end of the passive discharge device, in which the discharged goods (pill container, package) initially remain for further use.

In a preferred form, a switch is located at the end of the passive discharge device, which can allocate the incoming pill containers to different destinations, for example two or three destinations. In one embodiment, the allocation can be made by knowing the destination from the control system and the object tracking (the first incoming goods to destination 2, the second incoming goods also, the third incoming goods to destination 1, . . . ). In a preferred embodiment, object recognition is connected upstream of the switch, by means of which a destination query can be made in the control system (this is 4711, where does it have to go, answer, please send it to destination 2). It is also possible to link the system with work processes at the workstation (job 1 is being processed, so the goods are diverted to destination 1; then job 2 is being worked on, so the goods are diverted to destination 2, etc.).

In a preferred embodiment, the discharge device is an active discharge device. In particular, an active discharge device is understood to be a device that can convey a package or a pill container over a conveyor line using drive means. In a preferred embodiment, the discharge device is a conveyor device that is elongated along a conveyor line, for example a conveyor belt. The active discharge device can also be a rail on which the package or pill containers can be moved by a pushing or pulling mechanism. The active discharge device can also be a pneumatic tube.

In a preferred embodiment, the discharge device has a control in the form of a gate or optoelectronic detection of features to determine whether the pill container has been placed in the desired position (direction and/or what is up and what is down).

In a preferred embodiment, if the workstation exhibits a work surface, then part of the discharge device is located less than 2 m, preferably less than 1.5 m, preferably less than 1 m, from an edge of the work surface when viewed in a horizontal direction. It is particularly preferred when an operator working at the work surface can place a package or a pill container on a part of the discharge device without having to take a step, or with at least a few steps. There are also possible embodiments in which the discharge device passes by or starts immediately adjacent to the work surface.

If the workstation exhibits a work surface, then in a preferred embodiment, part of the discharge device is arranged at the level of the work surface, or slightly above or slightly below it, when viewed in a vertical direction. In particular, it is preferably arranged less than 2 m, preferably less than 1.5 m, preferably less than 1 m, preferably less than 0.5 m, from the surface of the work surface. It is particularly advantageous if an operator working at the work surface can place a package or pill container on a part of the discharge device without bending over or stretching.

In a preferred embodiment, at least one discharge device is provided, by means of which a pill container and/or a package can be supplied from the workstation to the mixing storage. However, embodiments are also possible in which more than one discharge device is provided per workstation. In a preferred embodiment, less than 10, more particularly less than 5, more particularly less than 4 discharge devices are provided per workstation.

Embodiments are conceivable in which the supply device and the discharge device are provided by the same conveyor device. For example, it is conceivable that the same conveyor belt is moved in one direction as a supply device and in a backward direction as a discharge device. In a preferred embodiment, however, the supply device is separate from the discharge device. This increases the number of possible material flows.

If, in preferred embodiments, conveyor devices are provided that transport the pill container and/or the package from other locations to other locations than the supply device and the discharge device, then designs are possible in which parts of the individual conveyor device are provided by the same components as other conveyor devices, or the supply device and the discharge device. In a preferred embodiment, it is possible for each conveyor device to be provided separately and with its own components. However, synergies can be created spatially if existing components are used to be part of different conveyor devices, or of the supply device and/or the discharge device. In particular, the use of switches allows conveyor devices to be formed for parts of the conveyor path they provide together with other conveyor devices, for example from a loading point to a switch, and then to be separate from other conveyor devices for other parts of the conveyor path they provide, for example from the switch to a delivery point.

If the method according to the invention is carried out on a device with several workstations, then in a preferred embodiment it is provided that a single discharge device is provided that can be loaded from all workstations. For example, a single active discharge device can be designed as a conveyor belt that passes all workstations. However, embodiments are also conceivable in which at least one workstation has its own discharge device. Embodiments are conceivable in which the existing discharge devices are all of the same type, for example, all are conveyor belts. However, embodiments are also possible in which, in the case of several workstations, at least one workstation has a discharge device of a type that is different from the type of another workstation. For example, one workstation may have a passive discharge device, such as a chute, and another workstation may have an active discharge device, such as a conveyor belt. In a preferred embodiment, at least one of the subsequent method steps is carried out:

- a pill container or package is supplied from the mixing storage to the first workstation
- via a supply device belonging to the conveyor system,
- a pill container or package is supplied from the mixing storage to the second workstation via a supply device belonging to the conveyor system,
- a pill container or package is supplied from the first workstation to the mixing storage via a discharge device belonging to the conveyor system,
- a pill container or package is supplied from the second workstation to the mixing storage via a discharge device belonging to the conveyor system,
- a pill container is supplied from the first workstation to the working storage device via a conveyor device belonging to the conveyor system, a pill container is supplied from the second workstation to the working storage device via a conveyor device belonging to the conveyor system, a pill container or a package is supplied from the first workstation to the second workstation via a conveyor device belonging to the conveyor system, a pill container or package is supplied from the second workstation to the first workstation by means of a conveyor device belonging to the conveyor system, a pill container is supplied from the working storage device to the first workstation by means of a conveyor device belonging to the conveyor system, a pill container is supplied from the working storage device to the second workstation by means of a conveyor device belonging to the conveyor system.

Supplying a pill container or package from the first workstation to the second workstation or vice versa can be used to efficiently divide up work steps. For example, a pill can be taken from the package and placed in a pill container at the first workstation, and a barcode can be stuck on the pill container at the second workstation for identification. Supplying a pill container or package from the first workstation to the second workstation can be used either as an alternative or in addition in order to check the work from the first workstation at the second workstation.

The invention relates to the operation of a repackaging device for repacking medications in pill form. There is a market for individually assembled pill packaging.

Such packaging may be in the form of strips of tubular bags (sometimes also called tubular blisters), in which bags are attached to each other and each bag contains the pills for taking at a specific time. Alternatively, several bags may be provided for one time of taking pills if the pills do not fit into one bag or the number of pills is too large for one check of the bag.

Another possible special form is where pills are individually wrapped and the packages of the pills to be taken at a specific time are tied together. Such packages can also be box-type containers whose compartments are assigned to the times at which the medication or medications in the respective compartment are to be taken. As a rule, these are filled manually by the patient themselves or by relatives or nursing staff.

An alternative, increasingly popular container form for individually assembled tablet packs is the so-called patient-specific pharmaceutical blister pack. These can be in the form of blister cards. The blister cards can correspond to the box-like containers or have other shapes, such as compartments arranged in a circle, and are preferably adapted for machine filling. For example, blister cards can do without flaps or slides that need to be opened at the individual compartments. The compartments can usually be closed with a foil.

The repackaging device used in the method according to the invention is suitable for repackaging medications in pill form, which are initially available as a loose bulk or in original blisters, into such containers.

The repackaging device used in the method according to the invention exhibits a multiplicity of pill containers that can be transported. The pill containers serve as a specific intermediate storage for the pills within the repackaging device. In a preferred embodiment, the invention starts at the point where the pills to be packaged are available either as a loose bulk, or as bulk packaged in bags or cans, or bulk packaged in large canisters, or in original packaging, in particular original blisters in repackaging. In a preferred embodiment, the invention presumes that the pills in this state are first transferred to pill containers that are suitable for transportation. This offers the advantage that the pill containers can be specially equipped for transportation within the repackaging device. It is common for the original packaging for pills, such as original blisters or the large-volume packaging for pills in bulk, not to be specifically designed for handling within a repackaging device. By providing a variety of transportable pill containers, the invention solves this problem and makes it possible to transport the pills to be repackaged well within the repackaging device.

In the context of the invention, a pill container that can be transported is understood to be, in particular, a blister carrier as known, for example, from EP 2 993 133 A1. Or a magazine or a cartridge with a compartment containing a bulk supply of pills and which exhibits a dispensing mechanism for dispensing one pill.

In a preferred embodiment, the pill container is designed as a magazine, whereby the magazine can hold a bulk supply of pills and the magazine exhibits a dispensing mechanism for dispensing a single pill.

In a preferred embodiment, the pill container is designed as a blister carrier, wherein the blister carrier can hold at least one original blister pack with pills.

In a preferred embodiment, the pill container has several compartments, each compartment being designed to hold a single pill or a small number of pills, and each compartment having a dispensing mechanism for dispensing a pill located in the compartment, wherein a small number of pills is understood to mean, in particular, a number of less than 20, preferably less than 10 and more preferably still less than 6.

According to the invention, the respective pill container exhibits at least one compartment as a receptacle for at least one pill. In a preferred embodiment, the volume of the compartment is greater than 500 $mm^3$, particularly preferred greater than 1000 $mm^3$, more particularly greater than 1200 $mm^3$, particularly preferred greater than 1500 $mm^3$. In a preferred embodiment, the volume of the compartment is less than 27000 $mm^3$, more preferably less than 20000 $mm^3$, more preferably less than 15000 $mm^3$, more preferably less than 10000 $mm^3$, more preferably less than 8000 $mm^3$, more preferably less than 5000 $mm^3$.

In a first embodiment, the respective compartment of the respective pill container exhibits a dispensing mechanism for dispensing a pill. Such a dispensing mechanism can be a simple flap, the opening of which can allow the pill to fall out of the compartment under gravity. However, the dispensing mechanism (ejector) can also be specially designed to dispense a pill from a magazine (canister) containing a large number of pills, in particular from a bulk supply of pills.

The dispensing mechanism can be passive. This means that the pill is dispensed by means of the dispensing mechanism using an externally supplied action. For example, a screw that separates the pills and a closing opening (slide, flap) can be driven and opened from the outside by a motor or actuator. For example, a slide that closes the respective compartment can be opened by an external action. Or a flap that closes the compartment can be opened. In an alternative embodiment, the dispensing mechanism is an active dispensing mechanism. This means that the dispensing mechanism itself exhibits a drive, for example in the form of an electric motor. After receiving a corresponding control command, the dispensing mechanism itself can actively dispense a pill.

In an alternative embodiment, the respective compartment of the respective pill container exhibits an opening closed by a foil, whereby a pill located in the compartment can be pushed out of the compartment through the opening, destroying the foil. Such dispensing mechanisms are known from original blisters from original packaging of pills.

The pill container can in particular be a blister carrier provided with an original blister according to FIG. 2 of EP 2 993 133 A1.

The repackaging device that can be operated using the method according to the invention exhibits at least one working storage device in which some pill containers can be stored. In a preferred embodiment, the repackaging device exhibits several working storage devices, in particular 2 or more, in particular more than 3, in particular more than 4. In a preferred embodiment, the repackaging device exhibits several working storage devices, in particular, however, less than 20 working storage devices, preferably less than 15 working storage devices. With the number of working storage devices, on the one hand, the number of simultaneously executable repackaging processes increases, and on the other hand, the number of working storage devices increases the complexity of the conveyor paths to be provided. In a preferred embodiment, in the context of the method according to the invention, a pill container is conveyed from a first workstation to a second workstation via a supply device belonging to the conveyor system. In a preferred embodiment, at least one of the subsequent method steps is carried out:

- a pill container (1) is supplied from the workstation (7) to the first working storage device (2) by means of a conveyor device belonging to the conveyor system,
- a pill container (1) is supplied from the workstation (7) to the second working storage device (2) by means of a conveyor device belonging to the conveyor system,
- a pill container (1) is supplied from the first working storage device (2) to the workstation (7) by means of a conveyor device belonging to the conveyor system,
- a pill container (1) is supplied from the second working storage device (2) to the workstation (7) by means of a conveyor device belonging to the conveyor system,
- a pill container (1) is supplied from the first working storage device (2) to the mixing storage (6) by means of a conveyor device belonging to the conveyor system,
- a pill container (1) is supplied from the second working storage device (2) to the mixing storage (6) by means of a conveyor device belonging to the conveyor system,
- a pill container (1) is supplied from the first working storage device (2) to a removal nozzle (50) for pill containers by means of a conveyor device belonging to the conveyor system,
- a pill container (1) is supplied from the second working storage device (2) to a removal nozzle (50) for pill containers by means of a conveyor device belonging to the conveyor system,
- a pill container (1) is supplied from a first working storage device (2) to the second working storage device (2) by means of a conveyor device belonging to the conveyor system,
- a pill container (1) is supplied from the mixing storage device (6) to the first working storage device (2) by means of a conveyor device belonging to the conveyor system,
- a pill container (1) is supplied from the mixing storage (6) to the second working storage device (2) by means of a conveyor device belonging to the conveyor system,
- a pill container (1) is supplied from the mixing storage (6) to a pill container removal nozzle (50) by means of a conveyor device belonging to the conveyor system.

In a preferred embodiment, more than five, preferably more than ten, pill containers can be stored in the working storage device. In a preferred embodiment, however, the working storage device is designed to be so small that it can only store less than 1000, preferably less than 500, preferably less than 400, preferably less than 300, pill containers. The greater the number of pill containers that can be stored in the respective working storage device, the less necessary it is to supply pill containers from the mixing storage to the working storage for a particular repackaging order. However, the larger the working storage device, the more elaborately a working storage device must be designed in order to be able to control the individual storage locations of the pill containers in the working storage device. The longer the travel distances for such a working storage device removal device, the longer it takes to process the respective repackaging order. In practice, it has proven advantageous to equip a working storage device with approximately 500 to 800 pill containers.

In a preferred embodiment, the working storage device is designed to allow storage and/or retrieval from an intermediate storage device of the working storage device while pills are being removed from the pill containers (dispensing) at another location of the working storage device.

In a preferred embodiment, the working storage device has a sensor system and/or a control system that can be used to determine unambiguously and without negligence what is located where and what the working storage device accesses when dispensing. For example, ID chips can be provided on pill containers, which are read by the receiving station. ID chips can be provided on the blister carriers, which are read by a gripper when they are placed in the drawer. The working storage device can be designed in such a way that no manual access to the drawers is possible and/or an anti-slip device is provided in the drawer.

In a preferred embodiment, the control system is aware of the types, but preferably also of the fill levels, of the pill containers. This helps to prevent a situation in which a pill is missing during the filling process. It is preferable to start only those orders for which all the pills are available in the working storage device.

In a preferred embodiment, an area in the working storage device can be provided in the manner of a parking lot. A new package into which the pills are to be repackaged, for example a so-called patient blister pack, which was initially positioned under an ejection unit, can be moved to the parking area until the missing pills arrive, so that production is not stopped, for example because a The patient blister can be returned from the parking lot to under the ejection unit when the pills arrive.

The working storage device can exhibit specific stamps for pressing out the pills from the pill container. For example, a set of 20 stamps can be provided, which are preferably individually interchangeable. The working storage device can also exhibit various pre-perforation tools, for example six. There are conceivable operating situations in which a tool is not available (missing), defective or unsuitable for use with a specific pill container and therefore needs to be changed. In a preferred embodiment, a job is only processed in the working storage device when all the pills are in the working storage device and all the necessary tools are in the access.

The working storage device exhibits a filing device in which a pill can be removed from a compartment of a pill container. In a preferred embodiment, the pill container is designed so that the dispensing mechanism of the respective compartment is a passive dispensing mechanism in which case the external handling means required to cause the passive dispensing mechanism to dispense a pill are provided on the filing device. The handling means are adapted to the dispensing mechanism. For example, if the dispensing mechanism is designed as a screw with a slide, the handling means are designed, for example, in such a way that they can apply a pushing force to the slide and push open the slide, or, for example, in such a way that they can grasp the slide and pull it open and can engage the screw with a drive and move it. If the passive dispensing mechanism exhibits a pivotable flap, the handling means can be designed as plungers that can be extended and can pivot the flap open. If the pill container is designed in such a way that the respective compartment exhibits an opening closed by a foil, whereby a pill located in the compartment can be pushed out of the compartment through the opening, destroying the foil in the process, a plunger can be provided as part of the filing device, which can exert pressure from the outside on the pill located in the compartment and thus push it out of the compartment through the opening, destroying the foil in the process. If the pill container exhibits an original blister, the plunger can act on the deformable compartment from the outside, deform it and thereby exert pressure on the pill located in the deformable compartment and push the pill out of the compartment through the opening, destroying the foil in the process. In a preferred embodiment, the filing device is equipped with different handling means so that it can also take a pill from a compartment of the respective pill container in the case of differently constructed pill containers.

If the pill container is equipped with an active dispensing mechanism, a means, for example an electrical contact or a radio network, can be provided on the filing device, by means of which a control command can be supplied to a correspondingly equipped receiving means of the pill container (for example an electrical contact or a receiving antenna on the pill container), with which the active dispensing mechanism can be controlled in the desired form, for example to dispense a single pill or a sequence of pills.

Embodiments are conceivable in which the filing device exhibits a single station, with the various handling means being arranged in the area of this single station in order to be used depending on the pill container, in order to remove a pill from a compartment of the pill container in the case of each pill container located at this station. Such an embodiment with a focus on a single station reduces the design of the filing device. On the other hand, this focus on a single station means that the station has a complex structure, especially when a large number of differently designed pill containers are used. Furthermore, it is conceivable that the removal of a pill from a compartment of a pill container takes longer with one pill container design than with another pill container design. If only a single station is provided within the filing device, the station is blocked for those pill container designs where the removal of the pill takes longer.

In a preferred embodiment, the filing device exhibits several stations at which a pill can be taken from a compartment of the pill container from a pill container. The stations of the filing device can be designed the same in a preferred embodiment, so that each station of the filing device can handle each type of pill container. This increases flexibility, but at the same time means that a high level of design effort is required. In an alternative embodiment, at least one of the existing stations is designed differently from the other stations. In a preferred embodiment, the plurality of existing stations of the filing device are designed differently from one another.

The repackaging device operable by the method according to the invention exhibits a packaging station in which a pill removed from the pill container in the filing device can be packed in a new package.

In a preferred embodiment, the packaging station exhibits a collection point and a printing and a sealing mechanism. The collection point is particularly the point at which the at least one pill, usually several pills, are brought together for a specific timing of taking pills. This can be done, for example, simply by means of a central funnel. Alternatively, it can be done by means of channels that connect the output points of the pill containers, which are located one above the other, and which end in containers that move along all the channels. It is also possible to successively eject the pills and collect them in the open compartment of a patient-ready blister pack.

In a preferred embodiment, each collection for a timing of taking pills (pouch or compartment of a card blister) is printed with the content and other information. For example, a PE strip can be placed under the collection point and a second PE strip can be printed and placed over the pills lying on the collection point and then both strips can be welded. It is also possible to photograph a completed but open patient blister, then print a foil for the entire compartment matrix and stick/weld it onto the blister. This closes and labels all compartments. However, there is also the option of two-stage bonding. First, an unprinted or standardized printed foil (morning, evening) is glued and then a second individual layer (patient name, drug name, etc.) is applied. Such an approach allows more flexibility in the material used, for example, a first material that is particularly suitable for sealing and a second material that is particularly suitable for printing.

In a preferred embodiment, a distinction is made at the collection point between a "pre-collection point" and a "final collection point". At the "pre-collection point", the packaging is collected in a container and the contents are checked. It is then dropped from the "pre-collection point" to the "final collection point", where the packaging is then carried out.

A pill transport device is provided with the repackaging device that can be operated in accordance with the invention. The pill transport device can transport a pill removed from the pill container in the filing device to the packaging station. In a particularly preferred embodiment, the pill transport device is a passive pill transport device. In particular, the pill transport device can be provided as a shaft or as a group of parallel shafts. There are conceivable embodiments in which the passive pill transport device exhibits a single shaft. This is preferably either the same size as the cross-section of the pill container or, preferably, slightly larger. The size is preferably matched to the shape of the pill container in such a way that a pill falling out of the compartment of the pill container during the removal process can be safely picked up by the shaft and falls down through the shaft to the packaging station. The embodiment of a passive pill transport device with only one shaft is particularly preferred for use with pill containers that have only a single compartment. However, a passive pill transport device with only one shaft can also be used in pill containers that exhibit multiple compartments. In such a design, the cross-section of the shaft is preferably chosen to be large enough to accommodate any pill, regardless of which compartment of the pill container it falls from. In an alternative embodiment, the passive pill transport device has several shafts, preferably several shafts arranged next to one another and, in particular, several shafts running parallel to one another. In a preferred embodiment, the passive pill transport device has as many shafts as the pill container used exhibits compartments. However, in such an embodiment, it should be noted that this may possibly limit the variety of pill containers that can be used. There are conceivable embodiments in which various pill containers are used that exhibit different numbers of compartments or differently arranged compartments. In such an embodiment, it must be ensured that the passive pill transport device is designed to transport pills from any compartment of any pill container of the repackaging device to the packaging station. In such an embodiment of the repackaging device operable by the method according to the invention, the passive pill transport device preferably exhibits only one large shaft or a small number of shafts, each of which is selected to be large.

The shafts can be aligned vertically so that a pill that falls out of the compartment of the pill container during removal ideally falls down without touching the shaft walls. Such an embodiment can prevent pills that hit the shaft walls from bursting or breaking. It also reduces contamination with "drug dust", which can be created when a pill slides along a shaft wall and is lightly abraded. However, there are also possible embodiments in which a pill transport device is used to transport a pill taken from the filing device along a predetermined, non-vertical path to a packaging station. In such a design, a passive pill transport device may, for example, exhibit angled shafts or shafts that spiral in a helix shape.

In a preferred embodiment, the pill transport device is designed as shown in FIGS. 4 and 6 of EP 2 993 133 A1, namely the space between the blister carrier shown in FIG. 4 and the filling blister shown in FIG. 5, wherein the pill transport device comprises the pre-dosing magazine.

In a preferred embodiment, an active pill transport device exhibits a pre-dosing magazine that can be driven by an electric motor from the location where the pushed-out pills fall into the pre-dosing magazine to a photo station and then through a control mechanism and finally to a transfer point in the patient blister pack.

An active tablet conveyor can also have a circulating cup conveyor.

The repackaging device that can be operated using the method according to the invention exhibits a mixing storage area in which several pill containers can be stored. This makes it possible to optimize the processes in the working storage device, the filing device and the packaging station for the process of specifically removing pills from the pill container and packaging them, in order to provide space for the storage of other medications that are not needed in the specific time frame. In addition, the mixing storage makes it possible to carry out processes on the pill containers, such as refilling, cleaning or other tasks not directly related to removing the pills from the pill container and packaging them, separately from the working storage device, the filing device and the packaging station, thus relieving them of some of the processes to be carried out in them.

In a preferred embodiment, the mixing storage is designed to be larger than the working storage device. This means that more pill containers can be stored in the mixing storage than in the working storage device. In a preferred embodiment, the mixing storage is designed to store more than 2,000, more particularly more than 5,000, more particularly more than 10,000, preferably 25,000 pill containers.

In a preferred embodiment, the mixing storage exhibits storage locations for different pill containers. The storage locations for different pill containers can differ in particular in their height, depth or width. With regard to the "width" of a storage location, it should be noted that it is common for picking devices to divide continuous storage surfaces into "virtual channels" by means of the control system operating the picking device. In such embodiments, a storage location as such on the shelf cannot necessarily be recognized by the human eye. However, the control of the picking device is programmed in such a way that it only places transport containers at certain points along the storage floor and leaves sufficiently large open spaces between these points, into which no pill containers are placed. The "width" of a storage location mentioned above can therefore also be realized by designing a control system operating a picking device accordingly and adjusting the width of the "virtual channels" used by it. The methodology of working with virtual channels is described, for example, in EP 1 598 291 A2.

In a preferred embodiment, the mixing storage is implemented as a picking device. In particular, the picking device exhibits a shelf for storing goods. Furthermore, the picking device exhibits a shelf-operating device that is suitable for storing goods in certain locations on the shelf, for example in a certain layer on a shelf of a shelf, and/or is suitable for retrieving goods that are located in a certain location in the storage, for example in a certain layer on a certain shelf of a shelf. Furthermore, a picking device exhibits a control system. The control system is designed to control movements of the storage and retrieval unit and movements of components of the storage and retrieval unit, whereby the term "control" in the sense of control engineering comprises not only control but also regulation and is to be understood as a generic term for control and regulation in control engineering. In particular, the mixing storage is designed in the manner of one of the picking devices known from EP 2 826 732 A1, DE 10 2005 012 910 A1, EP 2 042 477 A1 and EP 1 564 160 A1.

In a preferred embodiment, a pill container and a package that is different from the pill containers, such as a medication package, are stored in the mixing storage.

In a preferred embodiment, the pill containers in the mixing storage are stored in single-variety channels. The type can be determined by the pill container's property (i.e. A matches medication A) as defined by an ID, but other (possibly dynamic) properties, e.g. the fill level, can also be used. It is also conceivable that only completely empty pill containers are stored by type, because then, for example, several pill containers can be removed at once for refilling.

In a preferred embodiment, a mixing storage delivery device that is different from the supply device is provided, which is particularly preferred as part of a conveyor system. The mixing storage delivery device can be used to remove pill containers from the mixing storage. The mixing storage delivery device can be designed as a conveyor belt.

In a preferred embodiment, the mixing storage exhibits a storage device that is different from the mixing storage retrieval device, with which pill containers and/or packages that are different from the pill containers, such as medication packages, can be stored in the mixing storage.

In a preferred embodiment, the supply device begins in the mixing storage. In a preferred embodiment, the supply device exhibits a starting section. The starting section is preferably arranged within the mixing storage. In a preferred embodiment, the mixing storage exhibits a shelf operating device, preferably a movable gripper, wherein the starting section is arranged in the grip area of the shelf operating device. In a preferred embodiment, the shelf operating device can place a pill container or package held by it on the starting section. The starting section can, for example, be the start of a chute or a spiral.

In a preferred embodiment, the discharge device ends in the mixing storage. In a preferred embodiment, the discharge device exhibits an end section. The end section is preferably arranged within the mixing storage. In a preferred embodiment, the mixing storage exhibits a shelf operating device, preferably a movable gripper, with the end section being arranged in the grip area of the shelf operating device. In a preferred embodiment, the shelf operating device can pick up a pill container or a package held by it from the end section. The end section can be the end of a conveyor, for example a conveyor belt.

In a preferred embodiment, empty pill containers, in particular preferred empty blister carriers and/or empty magazines/canisters, are stored in the mixing storage. An empty pill container can be removed from the mixing storage via the supply device and supplied to the workstation for loading.

In a preferred embodiment, packages of pills, in particular preferred packages with original blisters or packages with a bulk of pills, are stored in the mixing storage. A package can be removed from the mixing storage and supplied to the workstation via the supply device so that at least one pill in the package can be repacked into a pill container at the workstation.

In a preferred embodiment, partially filled packages of pills, in particular packages with a few original blisters but not the complete original number of original blisters, or packages with a small number of pills, are stored in the mixing storage. Packages from which only some pills have been removed can be returned to the mixing storage for further storage via the discharge device. For example, a package that contains 4 original blisters unopened (=whose original number of original blisters is 4) can have one original blister removed at the workstation and the package can be returned to the mixing storage as a partially filled package with 3 original blisters by means of the discharge device.

In a preferred embodiment, in the mixing storage completely filled pill containers are stored. A completely filled pill container is understood to mean, in particular, a pill container in which at least one pill is present in each compartment of the pill container. A completely filled pill container can be transported directly from the mixing storage to the working storage device via a conveyor path of a conveyor system.

In a preferred embodiment, partially filled pill containers are stored in the mixing storage. A partially filled pill container is understood to mean, in particular, a pill container which exhibits more than one compartment and in which at least one compartment has at least one pill arranged in it and at least one compartment has no pills arranged in it. A partially filled pill container can be transported directly from the mixing storage to the working storage device via a conveyor path of a conveyor system. A partially filled pill container can be supplied to the workstation via the supply device in order to be filled with further pills.

In a preferred embodiment, the repackaging device operable by the method according to the invention exhibits a conveyor system. In a preferred embodiment, the conveyor system exhibits at least one conveyor, preferably an elongated conveyor. In a preferred embodiment, the conveyor is a conveyor belt or a roller conveyor. In a preferred embodiment, the conveyor exhibits drive means. In a preferred embodiment, the drive means can come into direct contact with the pill container to be transported. A drive means that comes into contact with the pill container can, for example, be a drive wheel that transmits its rotation by means of friction to the pill container to be moved. Gears can also be provided that can engage in appropriately designed racks/toothed lines on the pill containers. The conveyor can also have pushing means that engage behind a pill container to be transported and that push the pill container in front of them by means of their movement. There are possible embodiments in which the conveyor has two parallel rails that are designed so that the pill container to be transported resting on both rails. Conveying technology can be provided between the two rails, which moves the pill container resting on the rails along the rails, for example the pushing means described above.

In a preferred embodiment, the conveyor system has a conveyor loop and conveyors leading to or from the conveyor loop. In particular, a conveyor loop is understood to be a conveyor that runs in a ring. However, a conveyor loop can also be formed, for example, by two elongated conveyors that run in parallel and are driven in opposite directions, with transfer devices provided at each end that can transfer a pill container and/or a package from the end of one conveyor to the beginning of the other conveyor.

In a preferred embodiment, the supply device and/or the discharge device is part of a conveyor system. In a preferred embodiment, the supply device is not part of the conveyor system but is designed as a passive supply device, for example as a chute, while the discharge device is part of the conveyor system. In a preferred embodiment, the discharge device exhibits a conveyor and a transfer device or a switch, by means of which a pill container can be transferred from the conveyor, which forms part of the discharge device, to a further conveyor of the conveyor system, for example to a conveyor that forms a conveyor loop or part of a conveyor loop.

The use of a conveyor system makes it possible, in a maximum configuration, to control and manage all material flows, in particular

- the stock;
- supplying the required pill containers to the working storage device;
- storing pill containers that are not currently being used, for example by returning them from the working storage device to the mixing storage area; this even applies to partially filled pill containers in which one or more compartments have been emptied in the working storage device, but where it turns out that the pills still in it will not be needed for a long time; the invention makes it possible to remove such a partially filled pill container from the working storage device and transfer it to the mixing storage;
- storage of surplus full pill containers
- equipping multiple working storage devices
- equipping workstations with packages and corresponding pill containers
- equipping deblistering stations with corresponding pill containers
- exchange of working storage devices with each other for an individual mix in the respective working storage device In a preferred embodiment, the material flows can be controlled in such a way that

- no manual transport is necessary and/or
- the organization of the pill container supply can be controlled "unmanned" in "real time" and/or
- incorrect transport can be avoided.

In a preferred embodiment, a conveyor path is provided as part of the conveyor system, along which a pill container can be conveyed from the discharge device to the working storage device. In this way, pill containers that have been filled with pills at the workstation can be made available to the working storage device without delay.

In a preferred embodiment, a conveyor path is provided as part of the conveyor system, along which a pill container can be conveyed from the mixing storage to the working storage. In this way, pill containers stored in the mixing storage can be made available to the working storage.

In a preferred embodiment, a conveyor path is provided as part of the conveyor system, along which a pill container can be conveyed from the working storage device to the mixing storage device.

In a preferred embodiment, a first working storage device and a second working storage device are provided and, as part of the conveyor system, a conveyor path is provided along which a pill container can be conveyed from the first working storage device to the second working storage device.

In a preferred embodiment, a conveyor path is provided as part of the conveyor system, along which a pill container can be conveyed from the working storage device to a removal nozzle.

In a preferred embodiment, a conveyor path is provided as part of the conveyor system, along which a pill container can be conveyed from the working storage device to a workstation.

The method according to the invention for operating, preferably equipped with a control, a repackaging device provides in a preferred embodiment that the control

- activates the supply device so that the supply device supplies a pill container and/or a package from the mixing storage to the workstation, and/or
- activates the discharge device so that the discharge device supplies a pill container and/or a package from the workstation to the mixing storage.

The method according to the invention allows the process of dropping a pill into a pre-dosing magazine and checking it to be used.

The method according to the invention allows an integrated process to be carried out in which no open pills are handled outside the repackaging device. Open pills are only handled at the workstation belonging to the repackaging device.

The method according to the invention makes it possible to design the repackaging device in such a way that there is no need for large fall paths (especially for different types) through a funnel, in particular those where the same fall path has to be used for different types. This helps to avoid cross-contamination.

The method according to the invention allows a method of transferring bulk material into canisters (pill containers). The canister can be selected so that it is as small as possible in the flat expansion (narrow, possibly long), as high as possible, but still so that safe ejection is possible. From these canisters, 1 to n (n typically 4-10) canisters with an ejector are attached in a row. There is a hole in the mounting plate under the ejector of a canister. The pre-dosing magazine with m compartments, for example m=7, is located under the plate. The pre-dosing magazine can move under one of the canisters, e.g. under canister 2, with its chambers. Then the desired pill is dispensed into each compartment. Example: Pill 2 should be taken every morning=>pre-dosing magazine moves under canister 2 with compartment 1. Pill drops. The pre-dosing magazine advances 1 compartment, a pill drops, and so on until all 7 compartments have 1 pill.

The pre-dosing magazine can then move over the blister (typically 4×7 or 5×7), for example, and drop the 7 pills into the 7 (weekdays) of the 7×4 blister (4 timings of taking pills). Then it may be that one pill of type 4 is needed every evening on each day. The emptied pre-dosing magazine moves step by step under the ejector with the individual chambers and a pill of type 4 is placed in a compartment with each ejection. The weekly blister moves forward 4 positions so that the evening row comes under the path of the pre-dosing magazine. The pre-dosing magazine moves over the weekly blister and ejects the 7 evening pills. Now, for example, a pill of type 1 can be added every second day at noon. The pre-dosing magazine moves under ejector 1, which ejects a pill. The pre-dosing magazine advances by 2 (one compartment remains empty), the next pill is ejected, etc. The patient blister moves back so that "noon" comes under the path of the pre-dosing magazine and the pre-dosing magazine moves over the patient and ejects the 3 pills into the noon row. Now, for example, pills of another type can be added daily in the morning. The pre-dosing magazine moves under the respective type, the pills are ejected step by step (only one pill per compartment) and the patient's blister is brought into position and the pills are dropped.

The restriction chosen here as an example, of only one pill per compartment, is based on the assumption that the electronics can recognize the fall of the one pill from the case of no pills or breakage, but this is not yet secure enough. Therefore, in a preferred embodiment, the chamber of the pre-dosing magazine is also examined. After the drop, it can also be checked that the chamber is now empty. If the electronics can be improved to such an extent that monitoring the pill falling is sufficient (e.g. capacitive field, characteristic change in the dielectric), the pills can of course also be added from canister a) and canister c) one after the other into the pre-dosing magazine and the pre-dosing magazine only has to be moved over the patient blister once per timing of taking pills.

If 4-10 types are not enough, a device like this, consisting of canisters and a pre-dosing magazine (quick-turnover dispenser), can be attached several times along the patient blister's route. The patient blister passes through the quick-turnover dispensers until it reaches the end, where it continues into a module where the pills are pushed out of the original blisters into original blister carriers using stamps. At the end, the patient blister can move into the printing and sealing station, where the blister is covered with a foil that prints the contents and the timing of taking pills as well as other information on each compartment and if necessary, a cover card printed with any information (attached to an edge, preferably the short edge) is applied at a subsequent station. Preferably, the cover card can be folded over or is folded over so that the front side of the blister (short side*blister height) also contains the information that one would like to see (similar to a book spine). The canisters are refilled by pulling out the plate with the canisters and exchanging full canisters for empty canisters or type 4711 for type 5523.

The canister can have a chip that uniquely identifies it. In a refilling station, the canister can be placed in a reading station, the packaging with the goods scanned, the goods refilled, the packaging scanned again and returned (automatically or manually), while the canister is linked to the pill type in the software, so that the contents are clearly known via the chip. Preferably, the same type is always filled in to prevent cross-contamination and to have a specific ejector for the pill. In this case, the correctness of the filling is checked by the above process. The canister can also have a fill level control so that when it is becoming empty and/or is empty, a message is sent to the operator.

The proposed preferred embodiment, a combination of ejection modules for blister tablets and ejection modules for bulk material, allows both starting materials to be processed fully automatically under protected climate and purity conditions within a single machine. Depending on how much material is in bulk and how much is in packets, the number of modules can be combined. Since bulk is primarily used for large-scale consumption, the resulting constellation is suitable: e.g. 10 to 30 canisters and a very large number of original blisters.

BRIEF DESCRIPTION OF THE DRAWINGS

The invention will be explained in more detail in the subsequent figures, which merely represent examples of the invention. These show.

DETAILED DESCRIPTION

Figure 1:
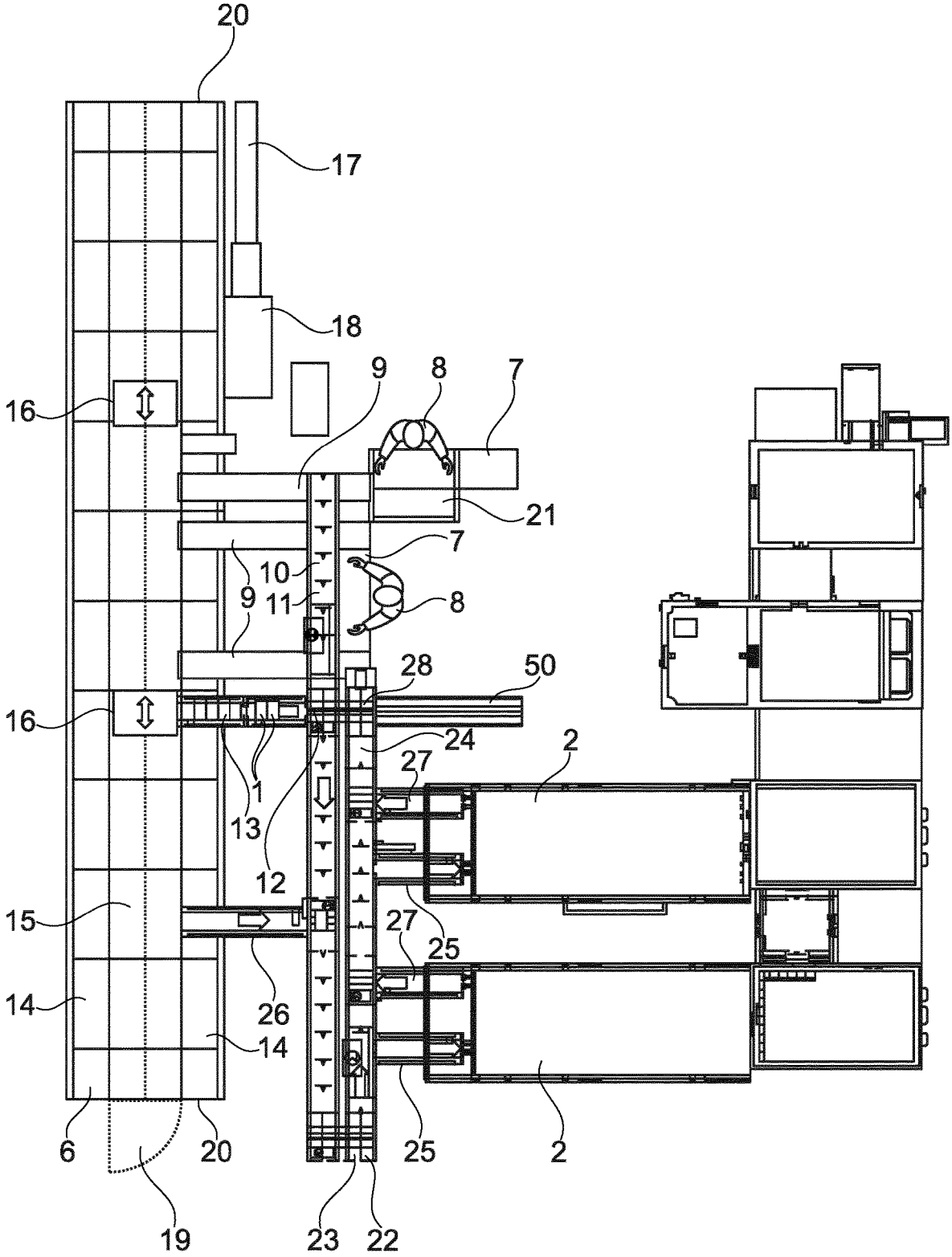
FIG. 1 a schematic plan view of a repackaging device that can be operated using the method according to the invention, according to a first embodiment.

FIG. 1 shows a repackaging device that can be operated using the method according to the invention for repackaging medications in pill form. The repackaging device exhibits a multiplicity of transportable pill containers 1. The repackaging device shown in FIG. 1 exhibits two working storage devices 2. Several pill containers can be stored in the working storage device 2. The pill container 1 can be designed, for example, like the blister carrier 120 shown in FIGS. 17 and 18, which contains an original blister pack 110, the original blister pack 110 containing several compartments, wherein each compartment is suitable as a receptacle for at least one pill and each compartment of the original blister pack 110 exhibits an opening closed by a foil, wherein a pill located in the compartment can be pushed out of the compartment through the opening, destroying the foil.

Figure 19:
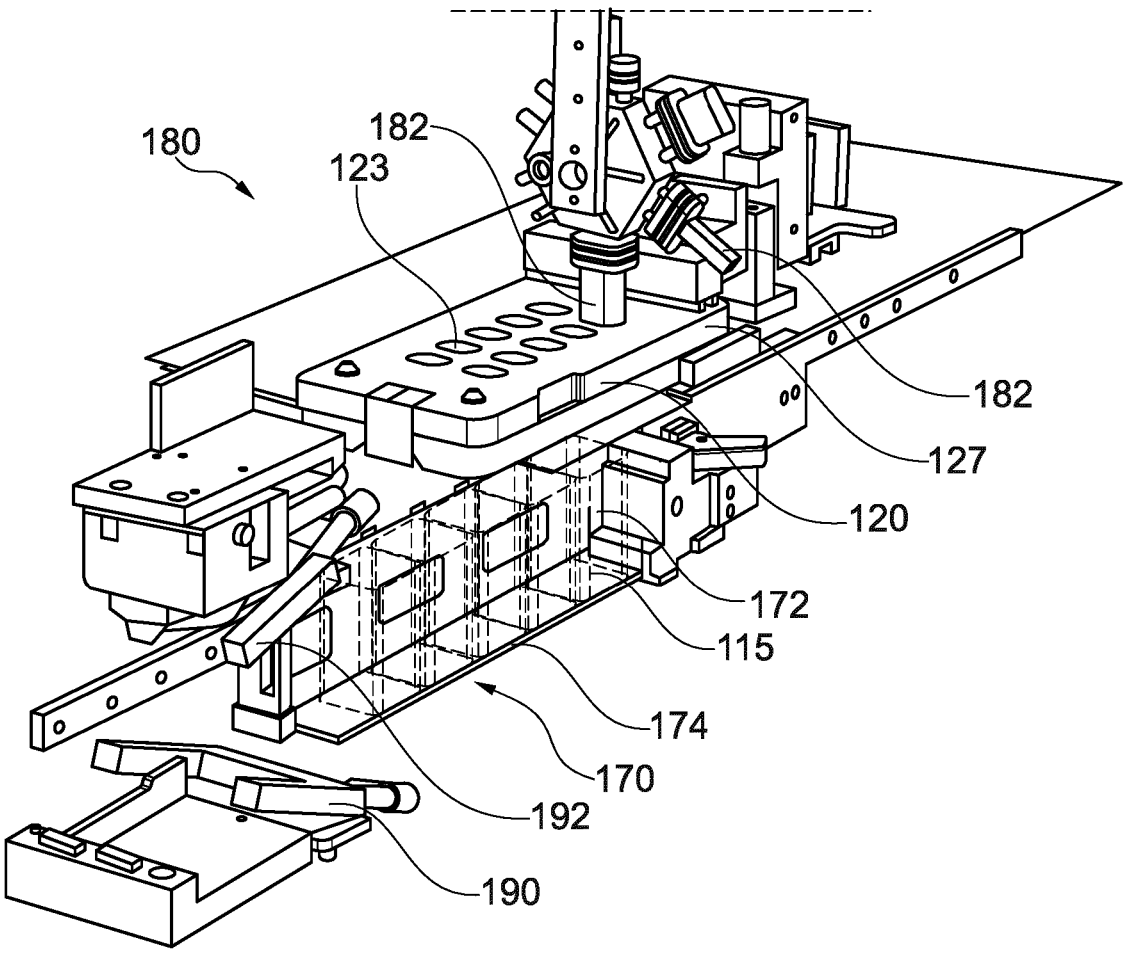
FIG. 19 is a schematic perspective view of a design for a deblistering device used as a filling station and a pre-dosing magazine.

The respective working storage device 2 can contain a filing device, such as, for example, the deblistering device 180 (FIG. 19). In the filing device, a pill can be removed from a compartment of a pill container.

The working storage device 2 also exhibits a packaging station in which a pill removed from the pill container in the filing device can be packed in a new package, for example, by using the pre-dosing magazine 170 in the filling blister 140 (FIG. 19, 22).

The working storage device 2 also exhibits a pill transport device that can bring a pill removed from the pill container in the filing device to the packaging station. A pill transport device can, for example, contain the pre-dosing magazine 170 with its pre-dosing compartments 172 according to FIG. 17, 20.

The repackaging device operable by the method according to the invention also exhibits a mixing storage 6. In the mixing storage 6, several pill containers and several packages containing pills can be stored.

In the embodiment shown in FIG. 1, the repackaging device operable by the method according to the invention exhibits two workstations 7 at which operators 8 can work. The operators 8 can unpack pills or blisters located in packages at the workstation 7.

One workstation 7 is equipped with a supply device 9 in the form of a chute, by means of which a pill container and/or a package can be supplied from the mixing storage 6 to the workstation 7. In this case, the supply device 9 in the form of a chute passes under a conveyor belt 11 forming part of a discharge device 10. The second workstation 7 exhibits two supply devices 9, each designed as chutes. These supply devices 9 also pass under the conveyor belt 11 forming part of the discharge device 10.

The repackaging device shown in FIG. 1, which can be operated using the method according to the invention, exhibits a discharge device 10 in addition to the three supply devices 9. Using the discharge device 10, a pill container and/or a package can be supplied from the respective workstation 7 to the mixing storage 6. In the embodiment shown in FIG. 1, the discharge device 10 exhibits a conveyor belt 11 that begins at the first workstation 7 and leads past the second workstation 7. Part of the discharge device 10 is a switch 12 by means of which a pill container 1 or a package conveyed along the conveyor belt 11 can be diverted onto the return conveyor belt 13. The return conveyor belt 13 leads from the switch 12 into the mixing storage. Consequently, a pill container 1 or a package can be supplied from the respective workstation 7 to the mixing storage 6 by the discharge device 10, namely by the conveyor belt 11, the switch 12 and the return conveyor belt 13.

The mixing storage 6 is preferably a picking device. In particular, the picking device is a picking device of the type known from EP 2 826 732 A1, DE 10 2005 012 910 A1, EP 2 042 477 A1 and EP 1 564 160 A1. The mixing storage 6 exhibits a plurality of shelves 14. The shelves 14 can be arranged on two opposite sides of an aisle 15. The mixing storage 6 exhibits two shelf operating devices 16 in the embodiment shown in FIG. 1. The shelf operating devices 16 can move linearly along the aisle 15. The respective shelf operating device 16 preferably exhibits a gripper, not shown in more detail in FIG. 1, which can be moved vertically along a column that forms part of the shelf operating device 16. The gripper can also be extended and retracted horizontally relative to the column, so that it can place pill containers 1 or packages held by it on a shelf or remove them from a shelf. For details of possible designs of such a shelf operating device, please refer to the disclosure content of the publications EP 2 826 732 A1, DE 10 2005 012 910 A1, EP 2 04 2 477 A1 and EP 1 564 160 A1, the content of which, with regard to possible designs for a shelf operating device, becomes part of the description of the repackaging device that can be operated using the method according to the invention, by virtue of the reference.

In the embodiment shown in FIG. 1, the return conveyor belt 13 ends in the area of the shelves 14 and thus at a location where the shelf operating device 16 can pick up a package or a pill container 1 located on the return conveyor belt 13.

The mixing storage area 6 exhibits a storage conveyor belt 17. Pill containers and packages placed on this storage conveyor belt 17 can be brought by means of the storage conveyor belt 17 and a transfer device 18 into an area within the shelf bases 14 onto which the shelf operating device can place the newly stored package or pick up the newly stored pill container 1. The mixing storage unit 6 also exhibits a door 19. In a preferred embodiment, the mixing storage unit 6 exhibits walls on the outer sides of the shelf bases 14 and on the end faces 20.

The first workstation 7 is equipped with an extraction unit 21. The extraction unit 21 can extract dust and at least reduce the risk of individual pills being contaminated by dust when they are handled by hand at workstation 7.

In the embodiment of the repackaging device operable by the method according to the invention, as shown in FIG. 1, the conveyor belt 11 continues beyond the switch 12. With the part by which the conveyor belt 11 extends beyond the switch 12, the conveyor belt 11 forms part of a conveyor system 22.

The conveyor system 22 exhibits a first conveyor path along which a pill container can be conveyed from the switch 12 along the further course of the conveyor belt 11 and a transfer device 23 provided at the end of the conveyor belt 11 and along a further conveyor belt 24 to one of the two feed conveyor belts 25 of the working storage device 2. Consequently, a pill container 1 can be transferred from the respective workstation 7 to one of the two working storage devices 2 along the first conveyor path.

In a preferred embodiment, the conveyor system 22 further exhibits a second conveyor path, which is formed by the discharge conveyor belt 26, a part of the conveyor belt 11, the transfer device 23, a part of the conveyor belt 24 and one of the two supply conveyor belts 25. By means of the second conveyor path, a pill container stored in the mixing storage 6 can be transferred to one of the two working storage devices 2. The discharge conveyor belt 26 begins at a location between the shelves 14, at which the shelf operating device 16 can deposit a pill container.

In a preferred embodiment, the conveyor system 22 exhibits a third conveyor path, which is formed by one of the two discharge conveyor belts 27, a part of the conveyor belt 24, the transfer 28, the switch 12 and the return conveyor belt 13. By means of the third conveyor path, a pill container located in the working storage device can also be conveyed back into the mixing storage 6.

In a preferred embodiment, the conveyor system 22 exhibits a fourth conveyor path that is formed by one of the two discharge conveyor belts 27 and a part of the conveyor belt 24 and that ends at the end of the conveyor belt 24 at the workstation 7. By means of this fourth conveyor path, a pill container 1 located in the working storage device can be conveyed to the second of the two workstations 7.

In a preferred embodiment, the conveyor system 22 further comprises a fifth conveyor path, which is formed by one of the two discharge conveyor belts 27, a part of the conveyor belt 24 and the transfer device 28 and ends in a removal nozzle 50 for empty pill containers 1. Empty pill containers 1 can be removed from the removal nozzle 50 and, for example, supplied to a cleaning station.

In a preferred embodiment, the conveyor system 22 exhibits a sixth conveyor path, which is formed by the discharge conveyor belt 27 of the working storage device 2 shown at the bottom in FIG. 1, a part of the conveyor belt 24 and the feed conveyor belt 25 of the working storage device 2 shown at the top in FIG. 1. By means of this sixth conveyor path, a pill container 1 can be transferred from the lower working storage device 2 to the upper working storage device 2.

Figure 2:
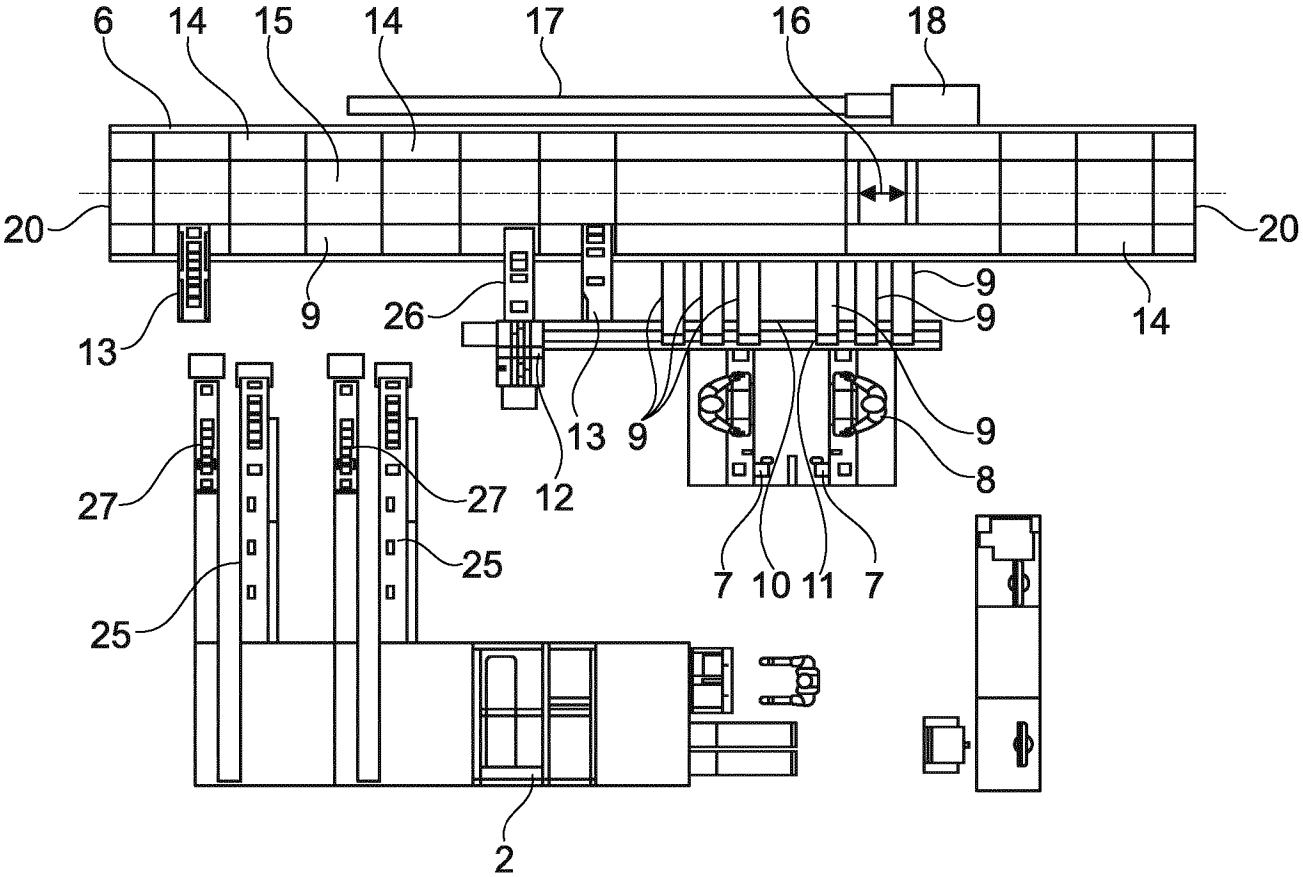
FIG. 2 a schematic plan view of a repackaging device that can be operated using the method according to the invention, according to a second embodiment.

The embodiment shown in FIG. 2 differs from the embodiment shown in FIG. 1 essentially in the elimination of the conveyor system. For the embodiment shown in FIG. 2, the switch 12 and the transfer device 28 have been redesigned. A crate 29 and a crate 30 are provided. The repackaging device that can be operated using the method according to the invention can be operated in the design shown in FIG. 2 in such a way that a pill container 1 to be supplied to the lower working storage device 2 is brought by the conveyor belt 11 over the switch 12 into the crate 29 (falls from the conveyor belt 11 into the crate 29). The repackaging device that can be operated using the method according to the invention, in the embodiment of FIG. 2, can be operated in such a way that a pill container 1, which is to be supplied from a workstation 7 to the upper of the two working storage devices 2, is supplied from the conveyor belt 11 via the switch 12 of the crate 30. An operator can then remove the pill containers 1 located in the crate 29 and place them on the feed conveyor belt 25 of the lower of the two working storage devices. Furthermore, an operator can remove the pill containers 1 located in the crate 30 and place them on the feed conveyor belt 25 of the upper working storage device.

Furthermore, in the embodiment shown in FIG. 2, a crate 32, 33 is provided at each end of the discharge conveyor belt 27. In this, an operator can remove pill containers from the repackaging device that can be operated using the method according to the invention and place them, for example, on one of the return conveyor belts 13 or the storage conveyor belt 17, so that these pill containers are stored back into the mixing storage 6. If the pill containers in the crates 32, 33 are empty, an operator can also supply these pill containers to a cleaning device, for example.

Figure 3:
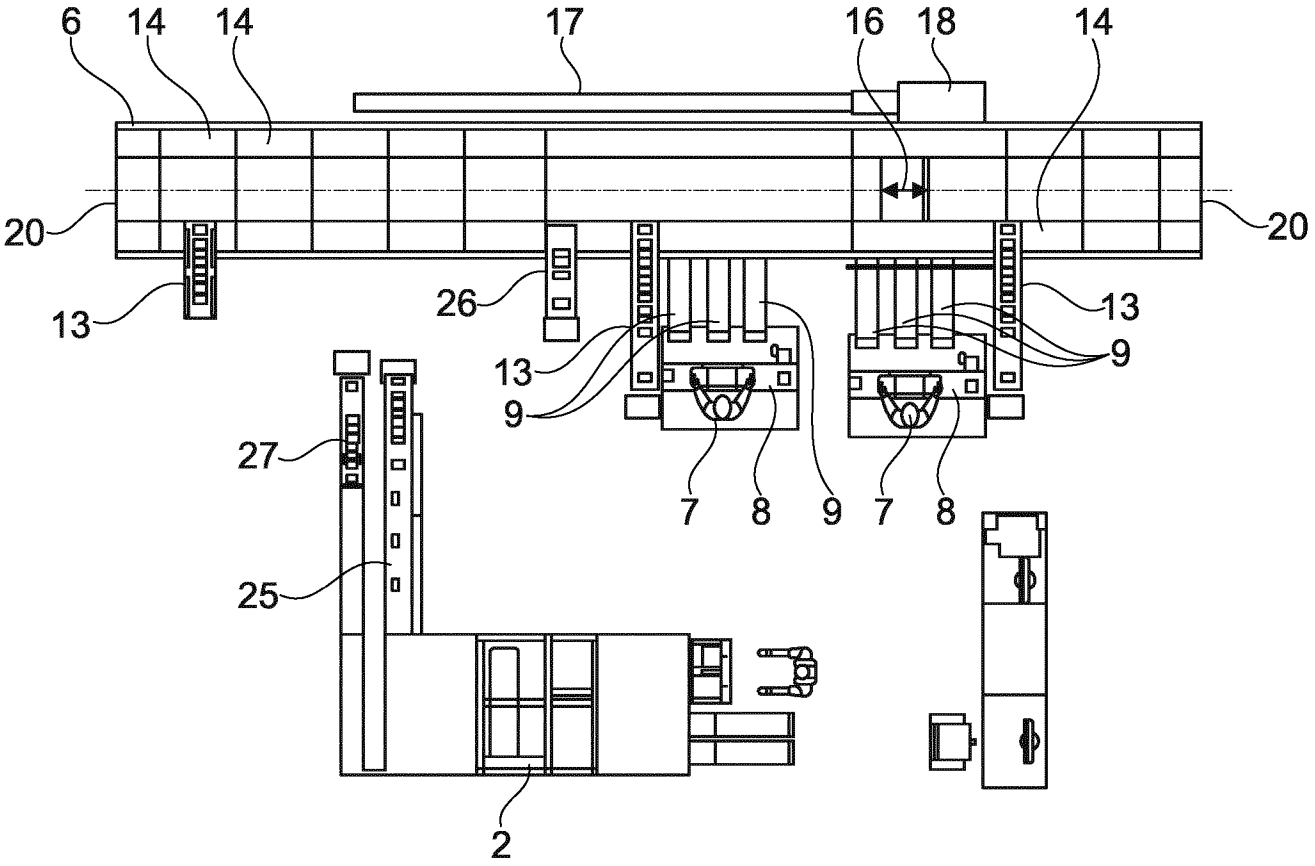
FIG. 3 a schematic plan view of a repackaging device that can be operated using the method according to the invention, according to a third embodiment.

The third embodiment according to FIG. 3 is a further development of the second embodiment shown in FIG. 2. In the third embodiment of FIG. 3, the switch 12 and a working storage device 2 with a feed conveyor belt 25 and a discharge conveyor belt 27 have been removed at the core. The third embodiment exhibits two workstations 7, wherein although an embodiment with only one workstation 7 is also conceivable. The workstations 7 each exhibit three supply devices 9 in the form of chutes. In addition, each of the workstations 7 exhibits a return conveyor belt 13, via which, for example, a pill container 1 or a package can be returned to the mixing storage 6. Furthermore, the workstations 7 exhibit the crates 34 into which the pill containers 1 are thrown from the workstations 7. Furthermore, the pill containers are thrown from the mixing storage 6 via the retrieval conveyor belt 26 into the crate 35. The pill containers in the crates 34 and 35 can then be supplied via the supply conveyor belt 25 to the working storage device 2.

The pill containers can be transported back to the mixing storage area 6 via the return conveyor belts 13. Pill containers can be removed from the working storage device 2 via the delivery conveyor belt 27. The pill containers from the working storage device 2 can be returned to the mixing storage area via the return conveyor belts 13.

Figure 4:
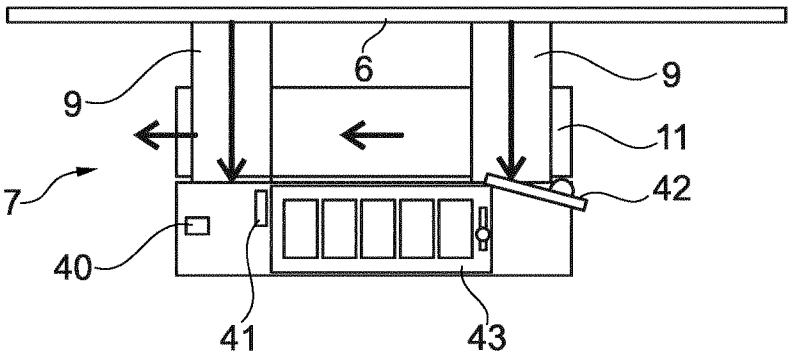
FIG. 4 a schematic plan view of a workstation of a repackaging device operable with the method according to the invention.

FIG. 4 shows a possible embodiment of workstation 7 of a repackaging device operable by the method according to the invention. The embodiment shown in FIG. 4 exhibits in the form of two chutes as supply devices 9 from the mixing storage 6. Furthermore, a scanner 40 and a printer 41 and a computer terminal 42 are provided at the workstation 7. The computer terminal 42 can consist of a screen that presents information to the operator 8 working at the workstation 7 alone. In a preferred embodiment, however, the computer system 42 is designed to be interactive and allows the operator 8 to interact. For example, the computer system 42 can have a touch screen or a keyboard next to the screen.

Figure 5:
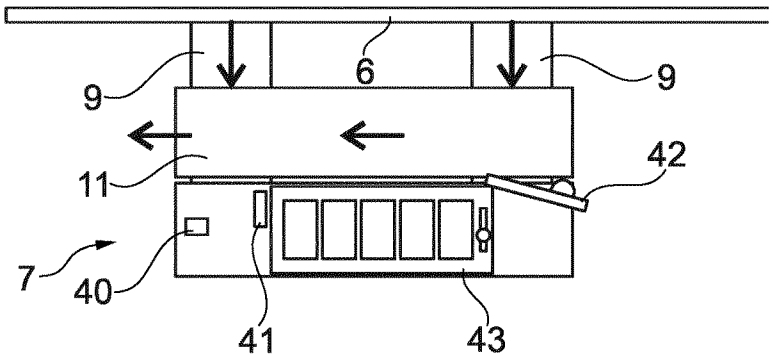
FIG. 5 a schematic plan view of a further embodiment of a workstation of a repackaging device operable with the method according to the invention.
Figure 7:
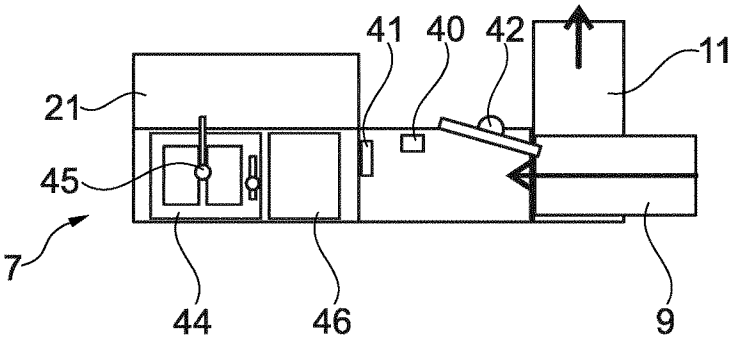
FIG. 7 a schematic top view of a further embodiment of a workstation of a repackaging device operable by the method according to the invention.
Figure 17:
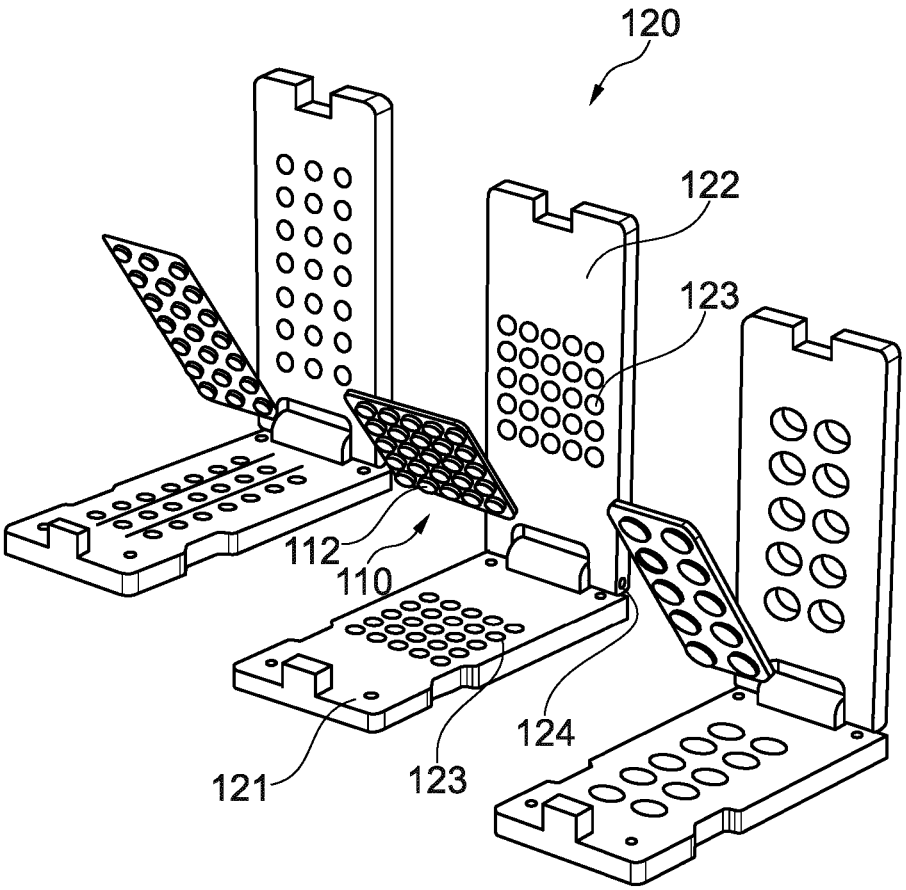
FIG. 17 a schematic perspective view of three examples of blister carriers that can be used as pill containers in the open position.

Furthermore, the workstation 7 has a receiving device 43 for a total of five blister carriers 120 known from FIGS. 17,19. In the embodiment shown in FIG. 4, the conveyor belt 11 belonging to the discharge device 10 is arranged below the chutes forming the supply devices 9. FIG. 5 shows a variant of the design of the workstation 7 according to FIG. 4, in which the conveyor belt 11 belonging to the discharge device 10 is arranged above the chutes forming the two supply devices 9.

The workstation 7 can be supplied via the supply devices 9 with pill containers 1 from the mixing storage 6, but also packages or empty blister carriers 120, i.e. blister carriers 120 in which no original blister pack 110 is arranged. At workstation 7, the operator 8 can remove the original blister packs 110 from the packages and insert them into the blister carriers 120. The operator can then place the blister carriers 120, which are equipped with original blister packs 110, on the conveyor belt 11.

Figure 6:
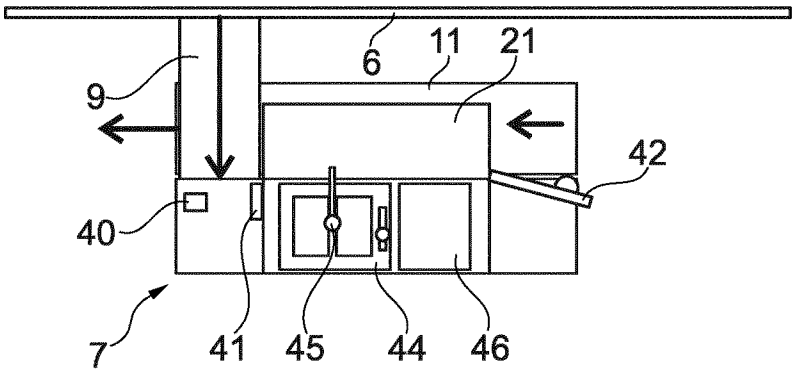
FIG. 6 a schematic top view of a further embodiment of a workstation of a repackaging device operable by the method according to the invention.
Figure 9:
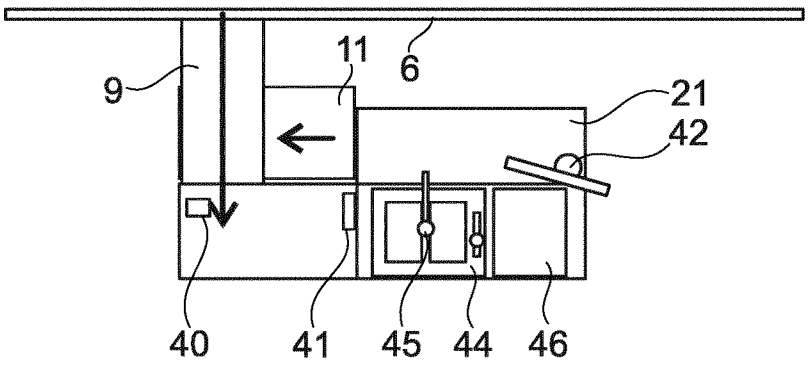
FIG. 9 a schematic plan view of a further embodiment of a workstation of a repackaging device operable by the method according to the invention.
Figure 8:
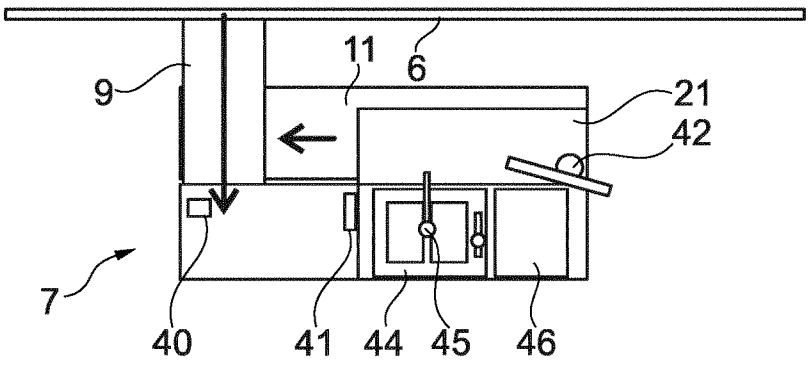
FIG. 8 a schematic plan view of a further embodiment of a workstation of a repackaging device operable by the method according to the invention.
Figure 11:
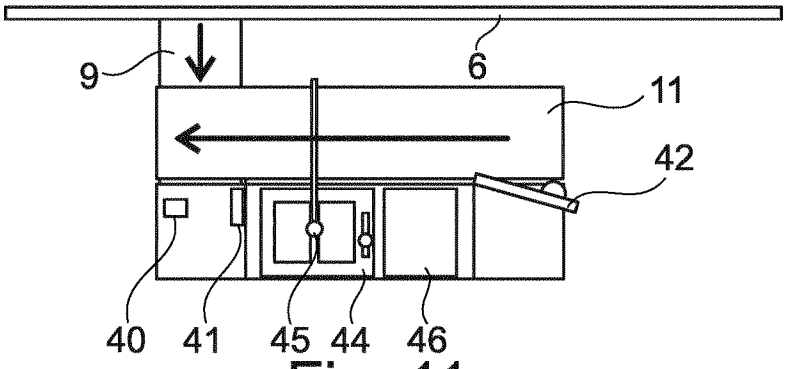
FIG. 11 a schematic top view of a further embodiment of a workstation of a repackaging device operable by the method according to the invention.
Figure 10:
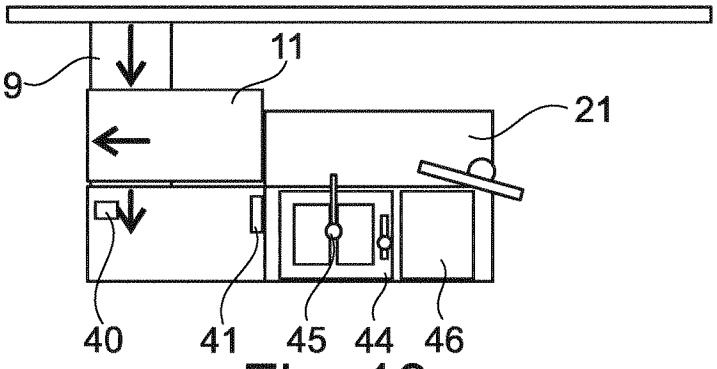
FIG. 10 a schematic top view of a further embodiment of a workstation of a repackaging device operable by the method according to the invention.

FIG. 6 shows a further variant of the design of workstation 7. Here, only one supply device 9 designed as a chute is provided. However, it is possible to bring empty, cleaned pill containers to the workstation 7 by means of a trolley (not shown). Furthermore, an extraction device 21 is provided. In addition, a receiving device 44 for a different form of pill container is provided instead of the receiving device 43. Likewise, a camera 45 is provided, which looks down on the receiving device 44 from above. Furthermore, an ejection area 46 is provided, where pills can be pushed out of the original blister packs 110, in order to insert the pills that have then been removed into a pill carrier 1 that is held in the receiving device 44. The camera 45 can be used to check whether the correct pill has been placed in the correct compartment of a pill container 1 held in the receiving device 44.

The embodiments of the workstations shown in FIGS. 7, 8, 9, 10, 11 and 12 differ from the embodiment shown in FIG. 6 only in the spatial arrangement of the individual components of workstation 7.

Figure 13:
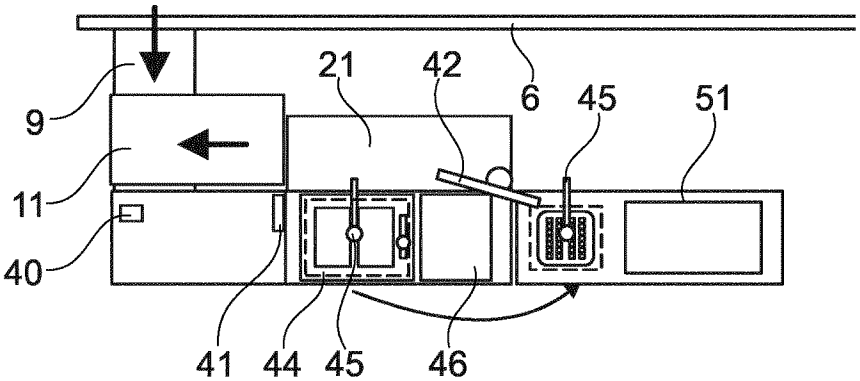
FIG. 13 a schematic plan view of a further embodiment of a workstation of a repackaging device operable by the method according to the invention.
Figure 12:
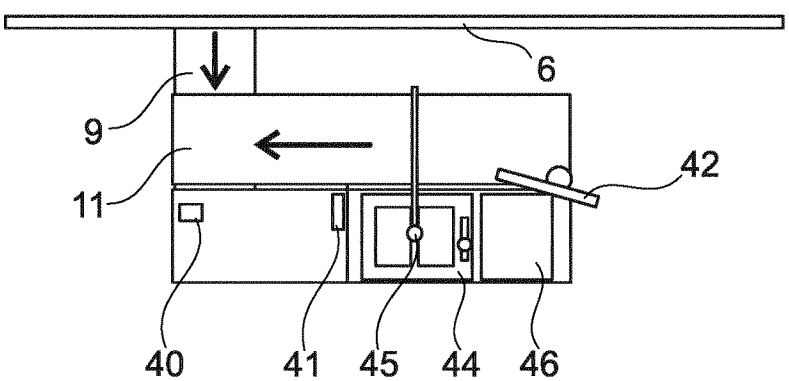
FIG. 12 a schematic plan view of a further embodiment of a workstation of a repackaging device operable by the method according to the invention.
Figure 14:
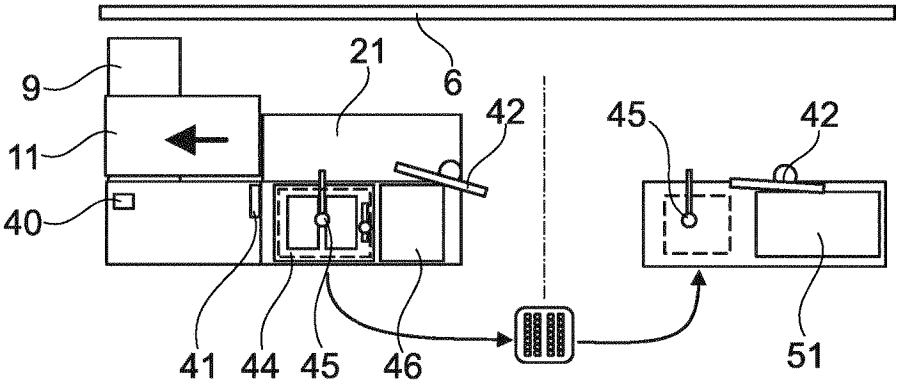
FIG. 14 a schematic plan view of a further embodiment of a workstation of a repackaging device operable by the method according to the invention.
Figure 15:
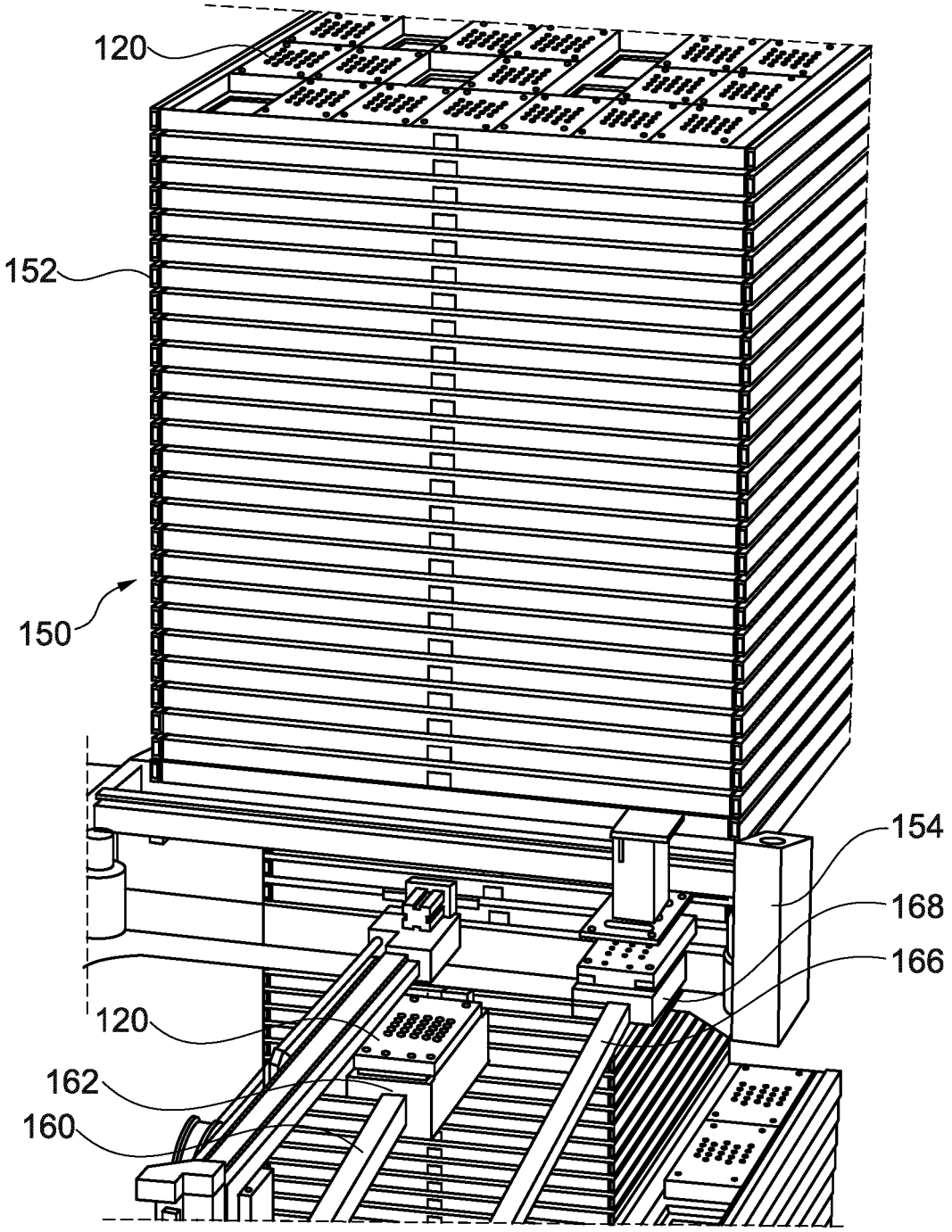
FIG. 15 a schematic perspective view of an intermediate storage location of a working storage device of the device according to the invention.

FIG. 13 and FIG. 14 show a modification of the workstation:

While in the previously described embodiments of FIGS. 4 to 13, a workstation 7 was assigned to one activity (repacking of original blisters into pill carriers or the removal of individual pills and filling into a generic pill container 1), a multifunctional workstation is shown in FIGS. 13 and 15. In FIG. 13, the left half of FIG. 13 shows the previously described transfer from packages to pill container 1. The right half of FIG. 13 shows a fault rectification and documentation workstation. The error correction and documentation workstation exhibit a camera 45, with which it can be proven by image documentation that the blister is correct after the error has been corrected. Furthermore, a printer system 51 is provided, with which the blisters can be reprinted. The error correction station is also connected to the mixing storage 6 by the conveyor belt 11 and the supply device 9.

If, for example, a broken pill cannot be completely removed automatically, or if a replacement pill cannot be fed in without further ado (taking so long that the entire logistics process is disrupted), then the finished blister must be reworked. To do this, a patient blister (for example) must be (partially) opened at a location where suction is used (e.g. workstation 7 with suction 21), and any fragments must be removed with tweezers, a package with a replacement tablet must be requested from mixing storage 6 and comes via the supply device 9. Then this pill must be added, the opened package must be labeled, the result must be documented by a second camera 45 (document camera) and, if necessary, a new sealing film must be generated (printing system 51) and the result must be documented again if necessary.

FIG. 14 shows that the error correction and documentation workstation (right part of FIG. 14) can also be arranged at some distance from the remaining part of the workstation 7 (left part of FIG. 14). In addition to the camera 45 and the printer 51, the error correction and documentation workstation can also exhibit a screen 42.

In the case of the device operable by the method according to the invention, the individual medications can be delivered in their original packaging and the original blister packs 110 can be removed from the respective (not shown) repacking at the workstation and separated. The separated original blister packs 110 are assigned to suitable blister carriers 120, which are used to package and store the different medications in their respective original blister packs 110 in the intermediate storage area 150. Blister carriers 120 can be provided for all desired medication types, whereby different medications with similarly shaped original blister packs 110 can be assigned to identical blister carriers 120. It is particularly preferred that the external dimensions of all blister carriers 120 are standardized, preferably identical.

Figure 18:
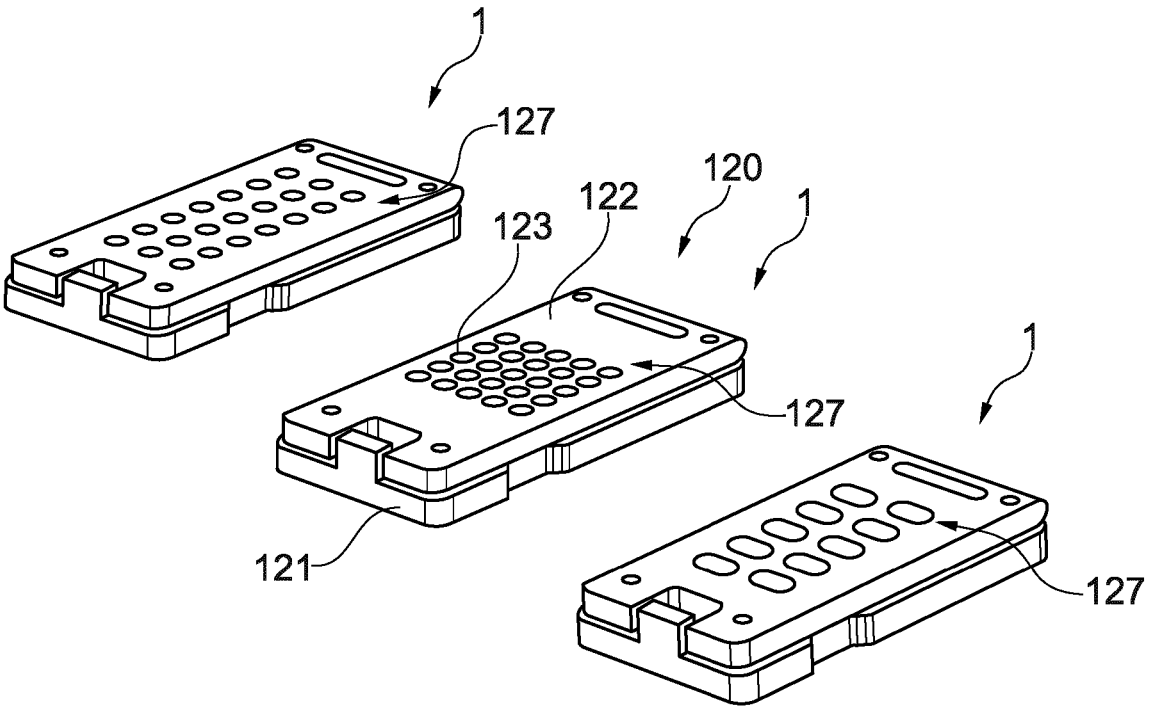
FIG. 18 is a schematic perspective view of the three blister carrier designs shown in FIG. 17 in the closed position.

Three examples of blister carriers 120 are shown schematically in FIGS. 17 and 18. A blister carrier 120 consists of a carrier part 121 and a lid part 122 hinged by means of a hinge connection 124 or the like. The carrier part 121 and the lid part 122 both exhibit a hole pattern 123 adapted to the respective original blister pack 110. The original blister pack 110 is placed with the film side facing upwards on the hole pattern 123 of the carrier part 121 of the blister carrier 120, as illustrated in FIG. 17. The hole pattern 123 receives the blister pockets 112 of the original blister 110. Then the lid part 122 is closed, as illustrated in FIG. 18. As a result, a pill container 1 is formed from the blister carrier 120 and the original blister pack 110. The external dimensions of the blister carriers 120 are preferably all identical, so that they can be efficiently stored in the intermediate storage unit 150 and transported. Each blister carrier 120 also exhibits an identification device 127, such as an RFID chip 127, for identifying the medication stored in the blister carrier 120.

Figure 16:
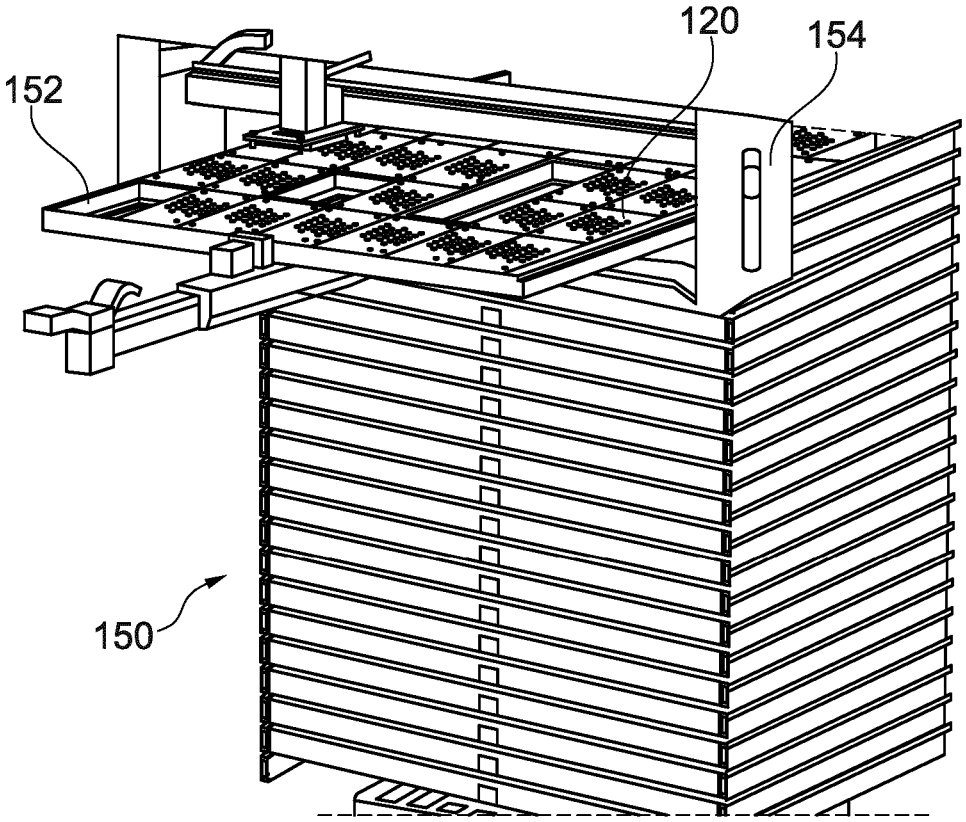
FIG. 16 a detailed view of the intermediate storage location shown in FIG. 14, with a drawer of the intermediate storage location pulled out.

The medications packaged in the blister carriers 120 are, as illustrated in FIG. 15, fed by known conveyor trolleys 162 on a conveyor path 160 to a drawer storage system 150, which is also known per se, in which the blister carriers 120 are stored in an efficient manner in drawers 152 that can be retracted and extended by means of an actuating device 154. FIG. 16 shows the drawer storage 150 with a drawer 152 extended. The drawer storage 150 allows optional access to each of the blister carriers 120 stored therein, with medications packaged in the respective original blisters 110.

Figure 20:
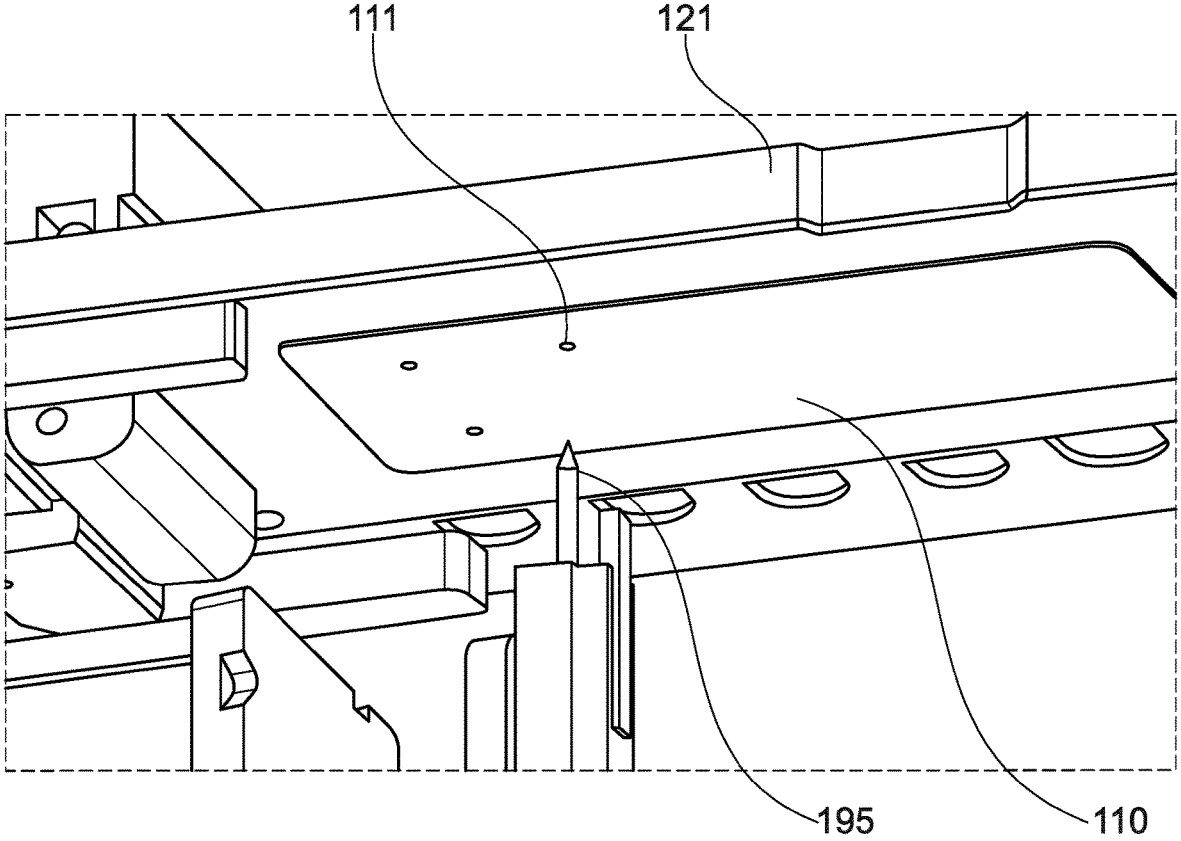
FIG. 20 a schematic perspective view of an embodiment of a perforating device connected upstream of the deblistering device.

When a particular medication is needed to fill a filling blister 140, the control technology (not shown) determines the position of the desired medication packed in one of the blister carriers 120, which is removed from the drawer storage 150 with the help of the actuating device 154 is removed from the drawer storage 150 and supplied by means of a conveyor carriage 168 on the conveyor line 166 of the deblistering device 180, which is shown schematically in FIG. 15. The blister carrier 120 arrives at the deblistering position, where the medications 115 are ejected one after the other into the compartments 174 of a pre-dosing magazine 170 with the aid of a suitable ejection tappet 182. As shown in FIG. 19, the deblistering device 180 of the shown embodiment exhibits a plurality of ejection tappets 182, which are arranged, for example, rotatably about an axis. The shape of the ejection tappets 182 is optimized for the smooth ejection of the medications 115 from the respective original blister packs 110 and is particularly adapted to the shape of the openings 123 of the blister carriers 120 used, the shape of the medications 115 and/or the shape of the blister pockets 112 of the original blisters 110. To optimize the deblistering process, the deblistering device 180 also preferably exhibits a perforating device 195, which is shown schematically in FIG. 20 and perforates the foil of the original blister 110 at the positions of the blister pockets 112. Such a perforation is designated schematically with the reference number 111.

Figure 21:
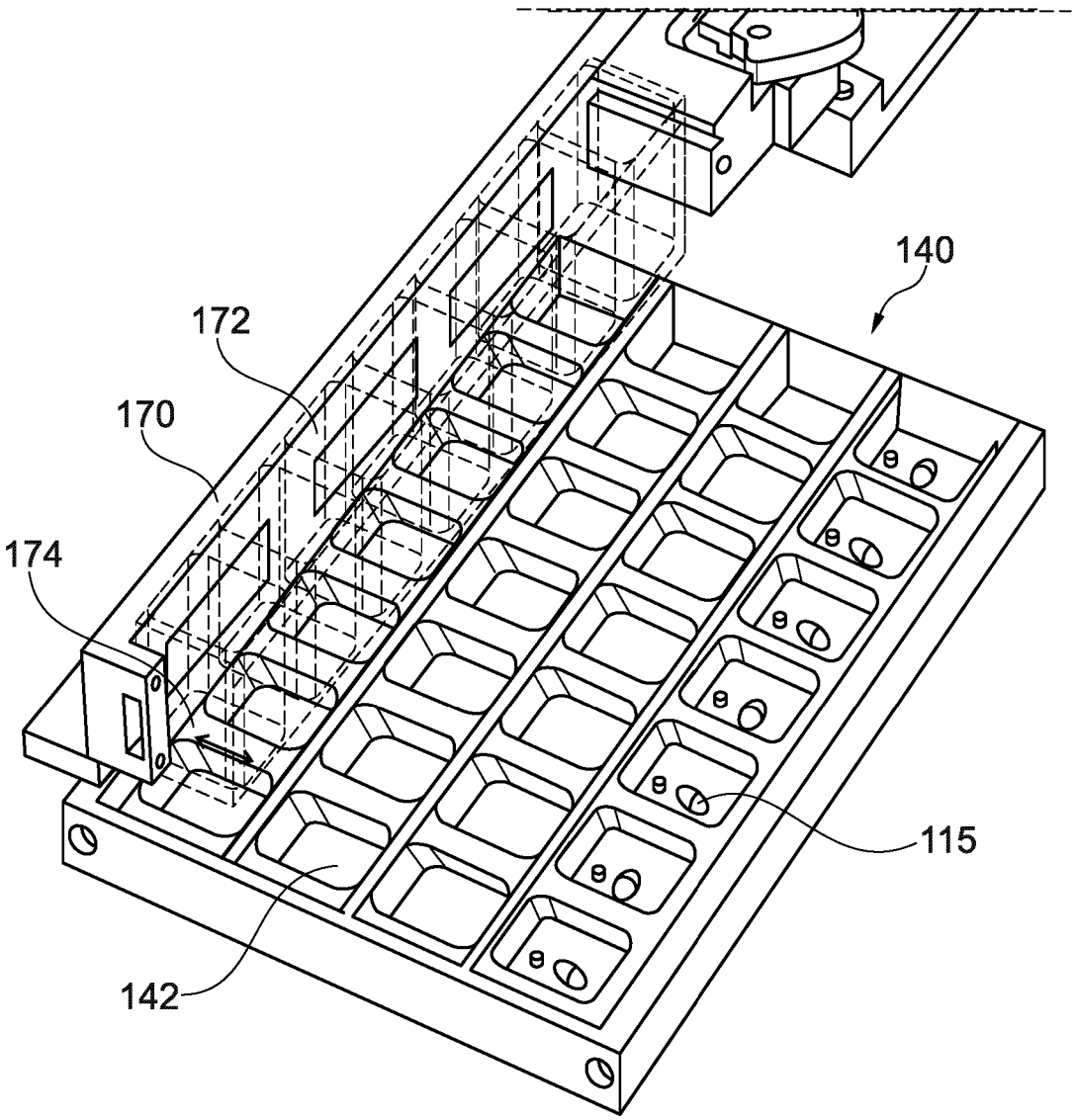
FIG. 21 a schematic perspective view of the process of transferring the medication from the pre-dosing magazine into the filling blister.

The pre-dosing magazine 170 of the shown exemplary embodiment of the invention shown in FIG. 21 exhibits seven pre-dosing compartments 172 corresponding to the seven weekday columns of the filling blister 140, wherein another number of compartments 172 is also possible according to the invention. In the lower area of the side walls of the pre-dosing compartments 172, slits are preferably provided for the purpose of visually checking whether or not a medication 115 is located in the respective pre-dosing compartment 172.

Finally, the medications are dispensed from the pre-dosing compartments 172 of the pre-dosing magazine 170 into the corresponding compartments 142 of the patient-specific filling blister 140, as shown in FIG. 21. For this purpose, the pre-dosing magazine 170 is positioned above the respective (time-of-day) line of the filling blister 140 and, by pushing back the base part 174 of the pre-dosing compartments 172, the medications 115 are dropped into the respective receiving compartments 142 of the filling blister 140. The filling blister 140 exhibits receiving compartments 142 arranged in a matrix configuration, which in the example shown are arranged in four rows corresponding to a number of times of taking the medication during a day (morning, noon, evening, night) and seven columns corresponding to the days of a week. However, the invention is not limited to this particular arrangement of the receiving compartments 142 of the filling blister 140.

Sensor devices 190, 192, such as light barriers, are preferably also provided, which check the transfer of the medications from the original blister pack 110 into the pre-dosing magazine 170 and further into the respective compartments 142 of the filling blister 140 and generate an error message in the event of an error.

The invention claimed is:

1. A method for operating a repackaging device for repackaging medication in pill form, wherein the repackaging device exhibits a plurality of transportable pill containers, wherein each pill container has at least one compartment as a receptacle for at least one pill, and each compartment either exhibits a dispensing mechanism for dispensing a pill or exhibits an opening sealed by a foil, whereby a pill located in the compartment can be pushed out of the compartment through the opening, destroying the foil, and exhibits a working storage device in which some pill containers can be stored, wherein the working storage device exhibits a filing device in which a pill can be taken from a compartment of a pill container, and a packaging station in which a pill removed from the pill container in the filing device can be packed in a new package, whereby a pill transport device is provided that transports a pill removed from the pill container in the filing device to the packaging station, and exhibits a mixing storage area in which some pill containers and some packages containing pills or blisters can be stored, and a workstation for unpacking pills or blisters located in packages; wherein a conveyor system with several conveyor paths is provided, and at least one of the subsequent method steps is carried out:

a pill container or a package is supplied from the mixing storage to the workstation via a supply device belonging to the conveyor system, a pill container or a package is supplied from the workstation to the mixing storage via a discharge device belonging to the conveyor system, a pill container is supplied from the workstation to the working storage device by means of a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage by means of a conveyor device belonging to the conveyor system, a pill container is supplied from the working storage device to a pill container removal nozzle by means of a conveyor device belonging to the conveyor system, a pill container is supplied from a first working storage device to a second working storage device by means of a conveyor device belonging to the conveyor system, a pill container is supplied from the mixing storage to the working storage device via a conveyor device belonging to the conveyor system, a pill container is supplied from the mixing storage to a removal nozzle for pill containers via a conveyor device belonging to the conveyor system, a pill container or a package is supplied from the mixing storage to the mixing storage by means of a conveyor device belonging to the conveyor system, a pill container or a package is supplied to the mixing storage by means of a storage conveyor belt.

2. The method of claim 1, wherein at least one of the two subsequent method steps is carried out:

a pill container or a package is supplied from the mixing storage to the workstation via a supply device belonging to the conveyor system, a pill container or package is supplied from the workstation to the mixing storage via a discharge device belonging to the conveyor system, and at least one of the subsequent method steps is carried out:

a pill container is supplied from the workstation to the working storage device via a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage device by means of a conveyor device belonging to the conveyor system, a pill container is supplied from the working storage device to a removal nozzle for pill containers by means of a conveyor device belonging to the conveyor system, a pill container is supplied from a first working storage device to a second working storage device via a conveyor device belonging to the conveyor system, a pill container is supplied from the mixing storage to the working storage device via a conveyor device belonging to the conveyor system, a pill container is supplied from the mixing storage to a pill container removal nozzle by means of a conveyor device belonging to the conveyor system, a pill container or a package is supplied from the mixing storage to the mixing storage via a conveyor device belonging to the conveyor system of the mixing storage, a pill container or a package is supplied to the mixing storage via a storage conveyor belt.

3. The method of claim 1, wherein the two subsequent method steps are carried out:

a pill container or a package is supplied from the mixing storage to the workstation via a supply device belonging to the conveyor system, a pill container or package is supplied from the workstation to the mixing storage via a discharge device belonging to the conveyor system, and at least one of the subsequent method steps is carried out:

a pill container is supplied from the workstation to the working storage device via a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage device by means of a conveyor device belonging to the conveyor system, a pill container is supplied from the working storage device to a removal nozzle for pill containers by means of a conveyor device belonging to the conveyor system, a pill container is supplied from a first working storage device to a second working storage device via a conveyor device belonging to the conveyor system, a pill container is supplied from the mixing storage to the working storage device via a conveyor device belonging to the conveyor system, a pill container is supplied from the mixing storage to a pill container removal nozzle by means of a conveyor device belonging to the conveyor system, a pill container or a package is supplied from the mixing storage to the mixing storage via a conveyor device belonging to the conveyor system of the mixing storage, a pill container or a package is supplied to the mixing storage via a storage conveyor belt.

4. The method of claim 1, wherein the two subsequent method steps are carried out:

a pill container or a package is supplied from the mixing storage to the workstation via a supply device belonging to the conveyor system, a pill container or package is supplied from the workstation to the mixing storage via a discharge device belonging to the conveyor system, and at least two of the subsequent method steps is carried out:

a pill container is supplied from the workstation to the working storage device via a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage device by means of a conveyor device belonging to the conveyor system, a pill container is supplied from the working storage device to a removal nozzle for pill containers by means of a conveyor device belonging to the conveyor system, a pill container is supplied from a first working storage device to a second working storage device via a conveyor device belonging to the conveyor system, a pill container is supplied from the mixing storage to the working storage device via a conveyor device belonging to the conveyor system, a pill container is supplied from the mixing storage to a pill container removal nozzle by means of a conveyor device belonging to the conveyor system, a pill container or a package is supplied from the mixing storage to the mixing storage via a conveyor device belonging to the conveyor system of the mixing storage, a pill container or a package is supplied to the mixing storage via a storage conveyor belt.

5. The method of claim 1, wherein the two subsequent method steps are carried out:

a pill container or a package is supplied from the mixing storage to the workstation via a supply device belonging to the conveyor system, a pill container or package is supplied from the workstation to the mixing storage via a discharge device belonging to the conveyor system, and at least seven of the subsequent method steps is carried out:

a pill container is supplied from the workstation to the working storage device via a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage device by means of a conveyor device belonging to the conveyor system, a pill container is supplied from the working storage device to a removal nozzle for pill containers by means of a conveyor device belonging to the conveyor system, a pill container is supplied from a first working storage device to a second working storage device via a conveyor device belonging to the conveyor system, a pill container is supplied from the mixing storage to the working storage device via a conveyor device belonging to the conveyor system, a pill container is supplied from the mixing storage to a pill container removal nozzle by means of a conveyor device belonging to the conveyor system, a pill container or a package is supplied from the mixing storage to the mixing storage via a conveyor device belonging to the conveyor system of the mixing storage, a pill container or a package is supplied to the mixing storage via a storage conveyor belt.

6. The method of claim 1, wherein the two subsequent method steps are carried out:

a pill container or a package is supplied from the mixing storage to the workstation via a supply device belonging to the conveyor system, a pill container or package is supplied from the workstation to the mixing storage via a discharge device belonging to the conveyor system, and all of the subsequent method steps is carried out:

a pill container is supplied from the workstation to the working storage device via a conveyor device belonging to the conveyor system, a pill container or a package is supplied from the workstation to the workstation again by means of a conveyor device belonging to the conveyor system, a pill container is supplied from the working storage device to the workstation by means of a conveyor device belonging to the conveyor system, a pill container is supplied from the working storage device to the mixing storage device by means of a conveyor device belonging to the conveyor system, a pill container is supplied from the working storage device to a removal nozzle for pill containers by means of a conveyor device belonging to the conveyor system, a pill container is supplied from a first working storage device to a second working storage device via a conveyor device belonging to the conveyor system, a pill container is supplied from the mixing storage to the working storage device via a conveyor device belonging to the conveyor system, a pill container is supplied from the mixing storage to a pill container removal nozzle by means of a conveyor device belonging to the conveyor system, a pill container or a package is supplied from the mixing storage to the mixing storage via a conveyor device belonging to the conveyor system of the mixing storage, a pill container or a package is supplied to the mixing storage via a storage conveyor belt.

* * * * *